US012150520B2

(12) United States Patent
Dombrow et al.

(10) Patent No.: US 12,150,520 B2
(45) Date of Patent: Nov. 26, 2024

(54) TRAIL RUNNING SHOE AND FLEXION PLATE INSERT FOR A TRAIL RUNNING SHOE

(71) Applicants: David H. Dombrow, Portland, OR (US); Kevin P. Fallon, Lake Oswego, OR (US)

(72) Inventors: David H. Dombrow, Portland, OR (US); Kevin P. Fallon, Lake Oswego, OR (US)

( * ) Notice: Subject to any disclaimer, the term of this patent is extended or adjusted under 35 U.S.C. 154(b) by 0 days.

(21) Appl. No.: 18/075,136

(22) Filed: Dec. 5, 2022

(65) Prior Publication Data

US 2023/0172313 A1 Jun. 8, 2023

Related U.S. Application Data

(60) Provisional application No. 63/287,235, filed on Dec. 8, 2021.

(51) Int. Cl.
*A43B 17/18* (2006.01)
*A43B 13/02* (2022.01)

(52) U.S. Cl.
CPC ..... *A43B 17/18* (2013.01); *A43B 13/026* (2013.01)

(58) Field of Classification Search
CPC ..... A43B 3/24; A43B 3/244; A43B 3/246; A43B 5/06; A43B 13/026; A43B 13/125; A43B 13/127; A43B 13/42
See application file for complete search history.

(56) References Cited

U.S. PATENT DOCUMENTS

| | | | | |
|---|---|---|---|---|
| 3,952,427 | A | 4/1976 | von den Benken et al. | |
| 4,348,821 | A | 9/1982 | Daswick | |
| 5,533,280 | A | 7/1996 | Halliday | |
| 5,826,352 | A | 10/1998 | Meschan et al. | |
| 6,041,525 | A * | 3/2000 | Kelley | A43B 5/00 36/72 A |
| 6,277,087 | B1 * | 8/2001 | Hess | A61F 5/0195 36/15 |

(Continued)

FOREIGN PATENT DOCUMENTS

| | | | |
|---|---|---|---|
| DE | 202014006154 | U1 | 10/2014 |
| GB | 648553 | A | 1/1951 |
| KR | 102133935 | B1 | 7/2020 |

*Primary Examiner* — F Griffin Hall
(74) *Attorney, Agent, or Firm* — Thomas P. O'Connell; O'Connell Law Firm

(57) ABSTRACT

A running shoe and a flexion plate insert. An upper and an outsole together define an inner volume. A tensioning system selectively constricts the shoe. Trimmable traction formations project from the shoe outsole, and cuttable drainage plugs permit draining of water. A flexion plate exhibiting asymmetric flexion characteristics is selectively retained atop the outsole by engagement of an aperture in the flexion plate with a mounting plug retained within the shoe or by a removable first midsole. The mounting plug and the aperture have eccentric portions that are out of alignment when the flexion plate and the first midsole are aligned and that align when the first midsole and the flexion plate are disposed at a given, non-zero angle. The first midsole can be an upper midsole, and a second, lower midsole can be disposed in a facing relationship with the upper midsole with the flexion plate therebetween.

22 Claims, 13 Drawing Sheets

(56) References Cited

U.S. PATENT DOCUMENTS 6,467,198 B1 * 10/2002 James ..... A43B 7/32 36/72 A
6,502,330 B1 1/2003 David et al.
6,775,930 B2 8/2004 Fuerst
7,096,605 B1 * 8/2006 Kozo ..... A43B 7/26 36/76 R
7,185,448 B2 * 3/2007 Schupbach ..... A43B 21/48 36/15
7,294,114 B1 * 11/2007 Clement ..... A61F 5/0195 36/15
7,665,169 B2 2/2010 Cheskin et al.
7,984,569 B2 * 7/2011 Chaney ..... A43B 13/24 36/15
8,056,261 B2 * 11/2011 Nakano ..... A43B 13/12 36/35 R
8,205,357 B2 6/2012 Keating et al.
8,850,718 B2 * 10/2014 Lubart ..... A43B 13/026 36/31
9,578,920 B2 * 2/2017 Grott ..... A43B 7/1445
9,756,900 B2 * 9/2017 Derrick ..... A43B 3/246
D806,374 S 1/2018 Weddle
10,945,489 B2 * 3/2021 Conrad ..... A43B 13/186
11,058,174 B2 * 7/2021 Hale ..... A43B 13/04
11,160,326 B2 * 11/2021 Bramani ..... A43B 3/244
11,963,574 B2 * 4/2024 Megrabyan ..... A43B 13/181
2001/0052195 A1 * 12/2001 Blakey ..... A43B 21/50 36/15
2005/0060917 A1 * 3/2005 Kenson ..... A43B 3/24 36/136
2007/0101614 A1 5/2007 Meschan
2008/0263900 A1 * 10/2008 Determe ..... A61F 5/0195 36/110
2009/0133288 A1 * 5/2009 Gallegos ..... A43B 7/223 36/71
2010/0180474 A1 7/2010 Clark et al.
2012/0047770 A1 * 3/2012 Dean ..... A43B 21/30 36/103
2013/0036628 A1 * 2/2013 Hussey ..... A43B 3/0078 36/87
2013/0247413 A1 * 9/2013 Cumbus ..... A43B 21/37 36/42
2014/0059895 A1 3/2014 Arciuolo
2014/0150297 A1 * 6/2014 Holmes ..... A43B 13/223 36/103
2015/0014463 A1 1/2015 Converse et al.
2016/0081429 A1 * 3/2016 Derrick ..... A43B 3/246 36/15
2018/0116335 A1 * 5/2018 Worobets ..... A43C 15/02
2019/0150557 A1 * 5/2019 Shorten ..... A43B 13/04
2020/0305543 A1 * 10/2020 Kajiwara ..... A43B 13/023
2020/0367603 A1 11/2020 Bartel et al.
2021/0392992 A1 * 12/2021 Duffy ..... A43B 13/26
2022/0125158 A1 * 4/2022 Ni ..... A43B 13/127
2022/0304418 A1 * 9/2022 Kaila ..... A43B 3/244
2022/0378147 A1 * 12/2022 Bruns ..... A43B 13/187
2023/0089617 A1 * 3/2023 Diard ..... A43B 13/226 36/29
2023/0124653 A1 * 4/2023 Farina ..... A61H 1/0266 36/25 R

* cited by examiner

TRAIL RUNNING SHOE AND FLEXION PLATE INSERT FOR A TRAIL RUNNING SHOE

RELATED APPLICATION

This application claims priority to U.S. Provisional Application No. 63/287,235, filed Dec. 8, 2021, which is incorporated herein by reference.

FIELD OF THE INVENTION

The present invention relates generally to running shoes. More particularly, disclosed herein is a durable, high-performance trail running shoe and a flexion plate insert for such a running shoe. The trail running shoe is adaptable and customizable in fit and performance not only according to user preferences but also in adaptation to trail running conditions.

BACKGROUND OF THE INVENTION

In recent years, trail running has experienced a significant increase in popularity in the United States and throughout the world. Indeed, over a recent ten year period, organized trail races exhibited a global increase of over 1,000%. In trail running, varied terrains introduce levels of challenge and enthusiasm that are difficult to match with road running. Running in the quiet of nature while witnessing scenery that is both pleasant and remarkable render trail running as much a spiritual event as a form of exercise and recreation. As compared to road running, the trail running athlete often speaks of experiencing less stress both mentally and physically as the pounding of road running is replaced by the relative quiet and resilience of the trail.

With the increased popularity of the sport, specialized trail running shoes have been developed to seek to meet the particular and demanding needs of running over varied trail terrains. For instance, to provide traction and control over potentially steep, granular, and slippery surfaces, purpose-built shoes have been developed with aggressive, knobby soles. Further and in view of the risk of injury and damage presented by jagged trail surfaces and hazards and the inherently loose footing involved, trail running shoes are typically more rigid than road running shoes. For instance, nylon plastic layers are often incorporated to protect against puncture wounds from sharp rocks, sticks, and other objects. Additionally, trail running involves relatively softer and more resilient surfaces as compared to road running such that trail running shoes require less cushioning. That reduced cushioning advantageously permits trail running shoes to exhibit a lower profile, which provides enhanced stability on uneven terrain and reduces the risk of injury due to turned ankles and falls.

Despite the development of specially adapted trail running shoes, the present inventors have recognized that a plurality of needs and shortcomings remain. Among the most important needs is for a trail running shoe that can be readily customized to the particular needs of a given user. It is equally desirable that the trail running shoe be exceedingly adjustable and reliable in fit and performance not only to the individual user but also to particular trail running goals and conditions. There is also a need for a trail running shoe that is exceedingly durable and stable while providing adaptable structural rigidity and protection to the wearer even in exceedingly harsh trail running environments.

SUMMARY OF THE INVENTION

With an awareness of the needs presented by the demanding sport of trail running, the present inventors set forth with the basic object of developing a trail running shoe that meets those needs without compromise of any kind in adaptability, functionality, structure, or material.

A more particular object of the invention is to provide a trail running shoe that is adaptable and customizable in comfort and performance not only to user preferences but also to trail running conditions.

A further particular object of the invention is to provide a trail running shoe that is adaptable in structural rigidity and protection to the wearer.

An additional object of embodiments of the invention is to provide a trail running shoe that is highly durable even in the face of harsh trail running conditions.

Another object of embodiments of the invention is to provide a trail running shoe that is adjustable and reliable in fit to individual users and to particular trail running goals and circumstances.

A related object of embodiments of the invention is to provide a removable and replaceable flexion plate insert for a trail running shoe that can be stably maintained against lateral displacement while permitting individual, controllable flexion.

Still another object of manifestations of the invention is to provide a flexion plate insert for a running shoe that can be readily inserted into and removed from the running shoe.

These and further objects and advantages of the present invention will become obvious not only to one who reviews the present specification and drawings but also to those who have an opportunity to run in an embodiment of the trail running shoe disclosed herein. However, it will be appreciated that, while the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more of the foregoing objects, an embodiment of the present invention for a trail running shoe can be considered to be founded on a shoe upper and a shoe outsole that are joined to define an inner volume for receiving a foot of a wearer. A tensioning system is operative to selectively constrict the shoe upper about the foot of the wearer, and traction formations are disposed in an array to project from the shoe outsole to provide adaptable traction. A flexion plate is non-destructively removable and replaceable relative to the inner volume of the running shoe.

The flexion plate exhibits a given resistance to plantar flexion and a given resistance to dorsiflexion. In certain embodiments, the flexion plate exhibits asymmetric flexion characteristics wherein the resistance of the flexion plate to plantar flexion is different than the resistance of the flexion plate to dorsiflexion. For instance, the resistance of the flexion plate to dorsiflection can be greater than the resistance of the flexion plate to plantar flexion. Such asymmetric flexion characteristics cause the flexion plate to permit excellent ground feel due to the permitted plantar flexion while demonstrating impact and sharps protection, stability, and enhanced energy return for propulsion due to the greater resistance of the flexion plate and thus the shoe to dorsiflexion. In preferred embodiments, the flexion plate is formed from carbon fiber material with asymmetric flexion characteristics.

As taught herein, a mounting plug can be disposed within the inner volume of the running shoe, and the flexion plate can have an aperture therein for selectively receiving the mounting plug. In certain embodiments, the running shoe additionally comprises a midsole for being retained within the inner volume of the running shoe, and the mounting plug is retained by the midsole. To limit lateral displacement of the flexion plate, the midsole can have a depression therein for receiving the flexion plate, and the depression and the flexion plate can have correspondingly shaped peripheries. Furthermore, the midsole can have a protuberating surface formation that projects within the depression while the flexion plate has a correspondingly shaped and located receiving formation thereby further locking the flexion plate against unintended lateral displacement.

According to embodiments of the invention, the mounting plug can have a base portion and a distal retaining lip operative to secure the flexion plate relative to the mounting plug. According to the invention, the distal retaining lip can have an eccentric lobe portion while the aperture in the flexion plate has an eccentric portion. Where the first midsole and the flexion plate are considered to have longitudinal axes traversing from the anterior to the posterior ends thereof, the eccentric lobe portion of the distal retaining lip and the eccentric portion of the aperture are configured to be out of alignment when the longitudinal axes of the flexion plate and the first midsole are in alignment. The eccentric lobe portion of the distal retaining lip and the eccentric portion of the aperture can be brought into alignment by a disposition of the longitudinal axis of the flexion plate at a predetermined, non-zero angle, such as an angle of approximately ninety degrees, relative to the longitudinal axis of the first midsole.

Embodiments of the running shoe can further incorporate a second midsole for being retained within the inner volume of the running shoe. The first and second midsoles are adapted to be disposed in a facing relationship with one another with the mounting plug retained by the first midsole facing the second midsole and with the flexion plate disposed between the first and second midsoles. For example, the second midsole can comprise a lower midsole while the first midsole comprises an upper midsole. The first midsole and the flexion plate can then be adapted to be disposed atop the second midsole.

In alternative embodiments, the mounting plug is fixedly retained within the inner volume of the running shoe atop the shoe outsole. So disposed, the mounting plug selectively retains the flexion plate. A midsole can additionally be included, the midsole being adapted to be retained atop the mounting plug and the flexion plate.

Also as taught herein, the traction formations disposed to project from the shoe outsole can each have a proximal base portion and a distal block portion that is narrowed in relation to the base portion. The distal block portions are adapted to be selectively and individually trimmed. With this, the individual traction formations and the contour provided by the overall array of traction formations can be selectively adjusted to permit selected, adaptable fit, traction, and performance characteristics. The distal block portions of the traction formations can, for instance, have a four-sided cross-sectional shape with a first dimension in one direction and a lesser second dimension in a second direction thereby to facilitate selective trimming.

Still further, one or more cuttable drainage plugs can be disposed in the outsole. The drainage plug has a distal end that closes off a conduit that is open to fluidic communication with the inner volume of the running shoe. The distal end of the drainage plug is adapted to be selectively cut away to permit water to drain from the inner volume of the trail running shoe. With this, a runner expecting wet running conditions can cut away one or more plugs to permit a ready draining of water from within the inner volume of the shoe.

Embodiments of the running shoe can incorporate reel-based tensioning systems. For instance, a first selectively rotatable tensioning reel can be retained by the shoe, and a first tension cord can be retained in a loop for extension and retraction by the first tensioning reel. A rotation of the first tensioning reel produces an incremental and selective adjustment of the effective length of the loop formed by the first tension cord. With this, the first tensioning reel can be selectively rotated and counter-rotated to produce a customized fit of the running shoe relative to the foot of the wearer.

In certain embodiments, a second selectively rotatable tensioning reel is retained by the shoe, such as relative to the shoe upper, and a second tension cord is retained in a loop for extension and retraction by the second tensioning reel. A rotation of the second tensioning reel produces an incremental and selective adjustment of the effective length of the loop formed by the second tension cord. Under such constructions, the first and second tensioning reels can be selectively rotated and counter-rotated to produce a further customized fit of the running shoe relative to the foot of the wearer.

Alternative embodiments of the invention can be characterized as a flexion plate insert for a running shoe, the shoe having a shoe upper and a shoe outsole joined to define an inner volume for receiving a foot of a wearer. The flexion plate insert is formed by a first midsole that retains a mounting plug in combination with a flexion plate with an aperture therein disposed to selectively align with and receive the mounting plug retained by the first midsole. The flexion plate exhibits a given resistance to plantar flexion and a given resistance to dorsiflexion. The flexion plate can be selectively retained by the first midsole by a reception of the mounting plug into the aperture in the flexion plate, and the first midsole and the flexion plate so joined can be selectively inserted into the inner volume of the running shoe.

In manifestations of the flexion plate insert, the first midsole has a depression therein for receiving the flexion plate. The depression and the flexion plate have correspondingly shaped peripheries to prevent unintended lateral displacement of the flexion plate. The first midsole can include a protuberating surface formation that projects within the depression, and the flexion plate can have a correspondingly shaped and located receiving formation.

The mounting plug retained by the first midsole of the flexion plate insert can have a base portion and a distal retaining lip. The distal retaining lip can again include an eccentric lobe portion, and the aperture in the flexion plate can have an eccentric portion. Where the first midsole and the flexion plate are considered to have longitudinal axes, the eccentric lobe portion of the distal retaining lip and the eccentric portion of the aperture are out of alignment when the longitudinal axes of the flexion plate and the first midsole are in alignment. The eccentric lobe portion of the distal retaining lip and the eccentric portion of the aperture can be brought into alignment by a disposition of the longitudinal axis of the flexion plate at a predetermined, non-zero angle, such as ninety degrees, relative to the longitudinal axis of the first midsole.

Embodiments of the flexion plate insert can further include a second midsole for being retained within the inner volume of the running shoe. In such constructions, the first and second midsoles are adapted to be disposed in a facing relationship with one another with the mounting plug retained by the first midsole facing the second midsole and with the flexion plate disposed between the first and second midsoles.

The flexion plate of the flexion plate insert can be constructed to exhibit asymmetric flexion characteristics with the resistance to plantar flexion being different than the resistance to dorsiflexion. For example, the resistance of the flexion plate to dorsiflection can be greater than the resistance of the flexion plate to plantar flexion. In certain, non-limiting embodiments, the flexion plate is formed from carbon fiber material with asymmetric flexion characteristics.

One will appreciate that the foregoing discussion broadly outlines the more important goals and certain features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

Figure 1:
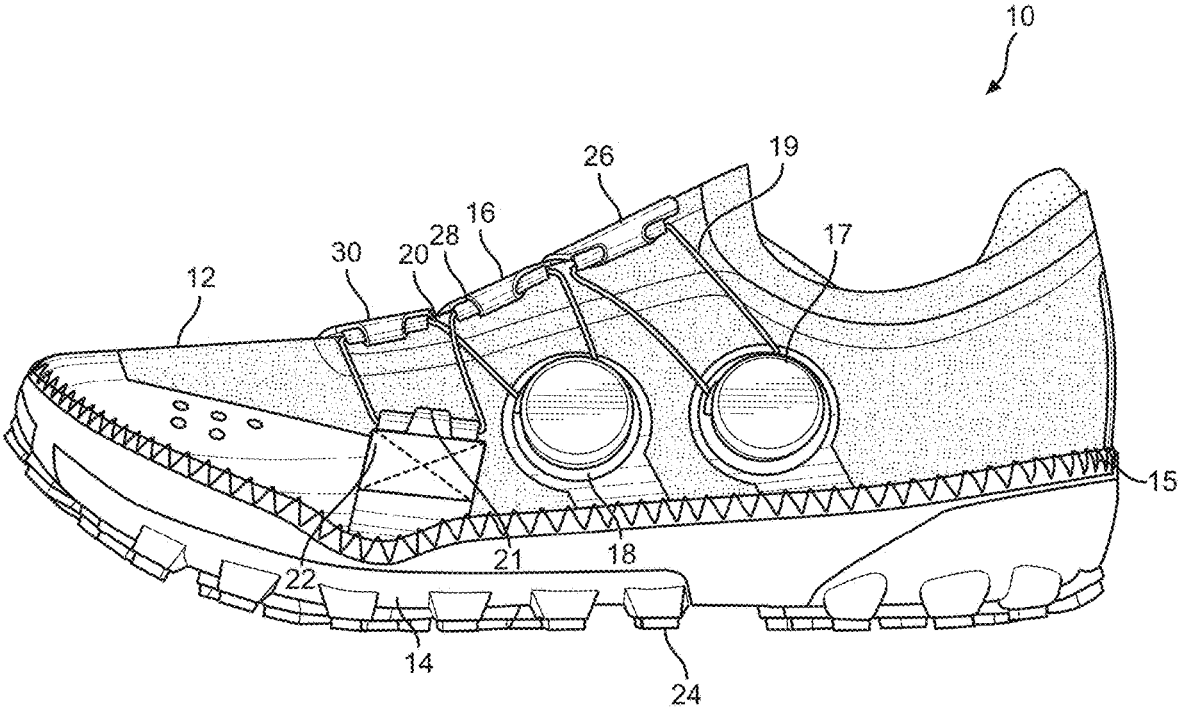
FIG. 1 is a view in left side elevation of a trail running shoe according to the present invention.

The trail running shoe and the flexion plate insert for a running shoe disclosed herein are subject to a wide variety of embodiments, each within the scope of the invention. To ensure that one skilled in the art will fully understand and, in appropriate cases, be able to practice the present invention, certain preferred embodiments and aspects of the trail running shoe and insert are described below and shown in the accompanying drawing figures. It will be understood, however, that the disclosed embodiments of the trail running shoe and flexion plate insert are mere examples thereof and should not be considered to be limiting in any manner.

Turning more particularly to the drawings, an embodiment of the trail running shoe is indicated generally at 10 in FIGS. 1 through 5. There, the trail running shoe 10 may be considered to be founded on a shoe body that is formed by a shoe upper 12 joined with an outsole 14. Together, the shoe upper 12 and the outsole 14 define an inner volume of the shoe 10 for receiving the foot of a wearer. In the present, non-limiting embodiment, the shoe upper 12 and the outsole 14 are joined by high-strength stitching 15. The trail running shoe 10 can be considered to have a longitudinal direction traversing from the toe of the shoe 10 to the heel of the shoe 10 and a lateral direction across the shoe 10 orthogonal to the longitudinal direction. Further, the trail running shoe 10 can be referenced as having an inner side for aligning with the arch of the foot of the wearer and an outer side for aligning with the outer side of the foot of the wearer.

Figure 2:
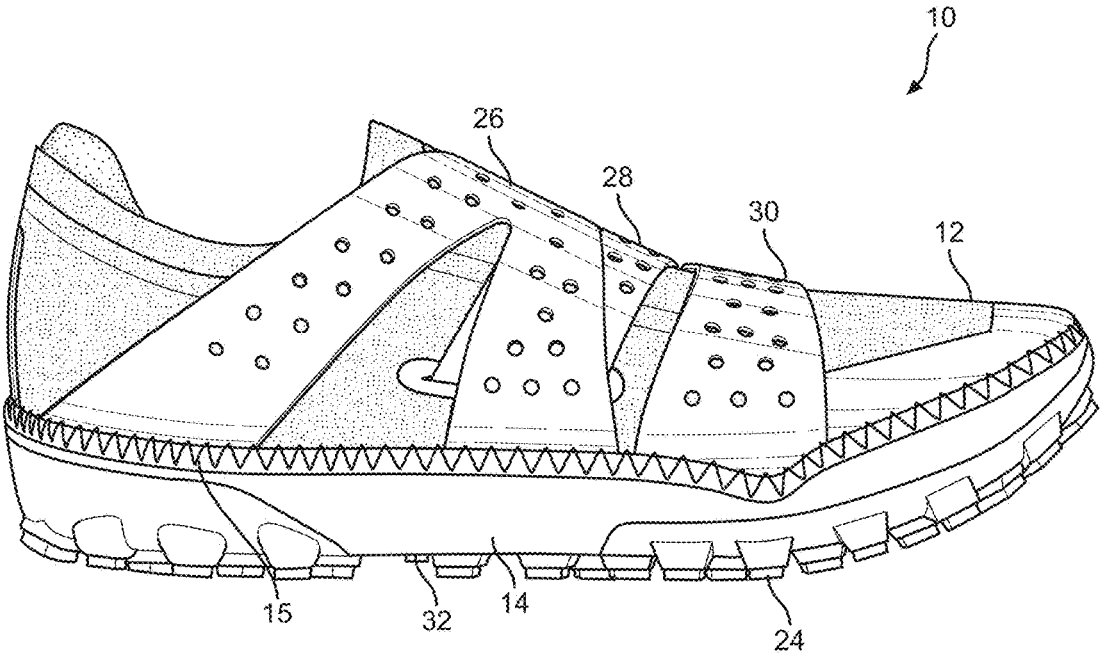
FIG. 2 is a view in right side elevation of the trail running shoe of FIG. 1.
Figure 4:
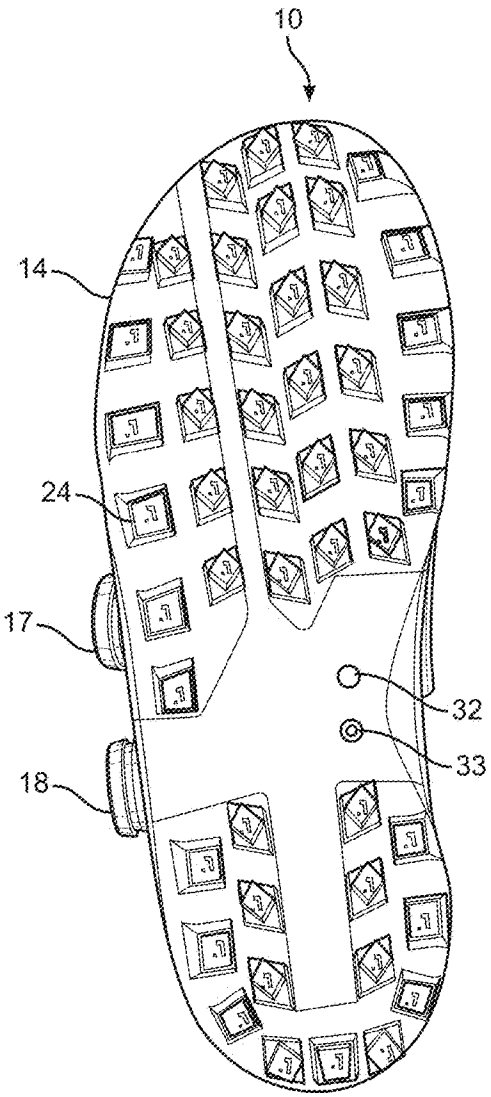
FIG. 4 is a bottom plan view of the trail running shoe of FIG. 1.
Figure 3:
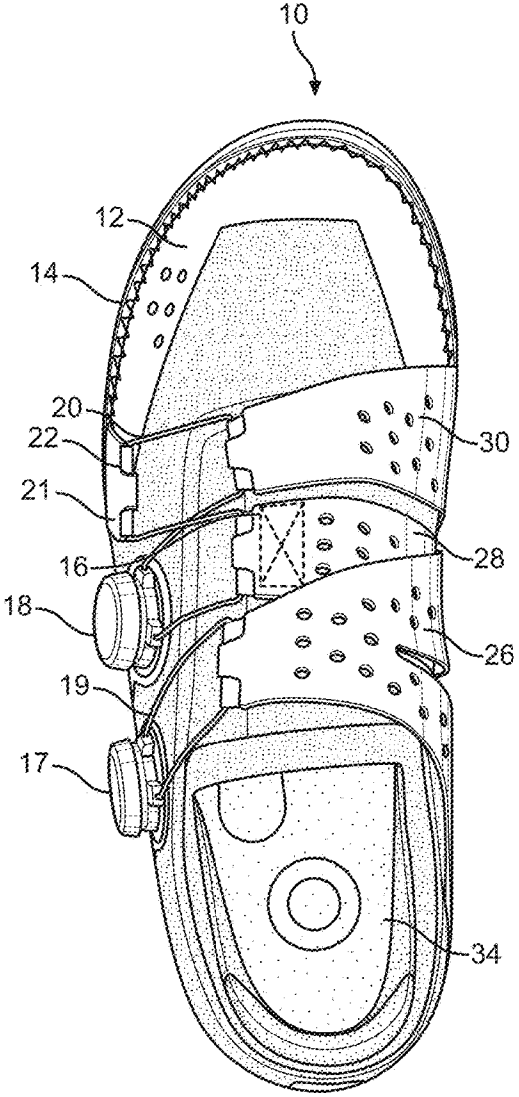
FIG. 3 is a top plan view of the trail running shoe of FIG. 1.

Cuttable traction blocks 24 project from the lower surface of the outsole 14 along the length and width thereof. As shown in FIG. 4, for instance, the cuttable traction blocks 24 are disposed in an array traversing longitudinally and laterally across the lower surface of the outsole 14. Cuttable drainage plugs 32, best seen in FIGS. 2 and 4, are disposed to project centrally from a mid-portion of the outsole 14. In the present embodiment, the cuttable drainage plugs 32 are disposed in general alignment with the arch portion of the outsole 14 adjacent to the inner side thereof.

A tensioning system is operable to selectively constrict the shoe upper 12 and the outsole 14 about the foot of the wearer. Numerous tensioning systems are possible within the scope of the invention, including laces, straps, bands, resilient materials, and any other tensioning system or combination thereof. Each should be considered to be within scope of the invention except as expressly excluded by the claims.

In the depicted embodiment, the tensioning system is founded on plural straps 26, 28, and 30 in combination with tension cords 19 and 20 that can be extended or contracted by selective operation of tightening mechanisms 17 and 18. The plural straps 26, 28, and 30 traverse laterally across the shoe upper 12, and tension cords 19 and 20 are operable by selective actuation of tightening mechanisms 17 and 18 to draw upon the straps 26, 28, and 30 to constrict the shoe upper 12 and the shoe outsole 14 about the foot of the wearer. In the illustrated embodiment, the tightening mechanisms 17 and 18 comprise first and second reels 17 and 18 of a reel-based tensioning system. The tightening mechanisms 17 and 18 are operative to constrict the tension cords 19 and 20 and the straps 26, 28, and 30 about the shoe upper 12 and, as a consequence, to constrict the shoe upper 12 and the outsole 14 about the foot of the wearer.

In the trail running shoe 10 of FIGS. 1 through 5, first, second, and third straps 26, 28, and 30 are provided. The first strap 26 traverses from a distal portion longitudinally forward of but adjacent to the foot opening of the shoe 10 to a bifurcated proximal portion that has anterior and posterior sections fixed to the shoe upper 12 and, additionally or alternatively, the outsole 14 adjacent to the junction between the shoe upper 12 and the outsole 14 on the inner side of the shoe 10 with a body portion of the first strap 26 spanning therebetween. The second strap 28 traverses from a distal portion longitudinally spaced further forward of the foot opening of the shoe 10 relative to the first strap 26 to a proximal portion fixed to the shoe upper 12 but spaced from the outsole 14 on the inner side of the shoe 10 with a body portion of the second strap 28 spanning therebetween. Finally, the third strap 30 traverses from a distal portion further longitudinally spaced further forward of the foot opening relative to the first and second straps 26 and 28 and adjacent to the toe portion of the shoe 10 to a proximal portion fixed to the shoe upper 12 and, additionally or alternatively, the outsole 14 adjacent to the junction between the shoe upper 12 and the outsole 14 to the inner side of the shoe 10 with a body portion of the third strap 30 spanning therebetween.

The distal end of each of the first, second, and third straps 26, 28, and 30 retains a low friction sleeve 16 through which passes a tension cord 19 or 20. More particularly, a first tension cord 19 passes through the low friction sleeve 16 of the first strap 26, and a second tension cord 20 is looped to pass through the low friction sleeve 16 of the second strap 28, through a low friction sleeve 21 of an anchor strap 22 that is fixed adjacent to the junction between the shoe upper 12 and the outsole 14 to the outer side of the shoe 10, and through the low friction sleeve 16 of the third strap 30. The proximal ends of the first tension cord 19 are retained by a first reel 17 of the reel-based tensioning system, and the proximal ends of the second tension cord 20 are retained by a second reel 18 of the reel-based tensioning system. The first and second reels 17 and 18 in the present embodiment are fixedly disposed on the shoe upper 12 to the outer side thereof.

In certain non-limiting embodiments, the reel-based tensioning system can, for instance, be as taught by U.S. Pat. Nos. 8,468,657, 9,138,030, and 9,706,814, each of which being incorporated herein by reference. For avoidance of doubt, the structure of reel-based tensioning systems and components as disclosed in the foregoing patents and that may be incorporated into the trail running shoe 10 are not claimed or intended to be claimed herein. It is recognized, however, that the advantageous incorporation and placement thereof may themselves carry inventive weight.

In any event, by rotation of the first and second reels 17 and 18, the reel-based tensioning system so established permits the selective adjustment of the effective lengths of the loops formed by the first and second tension cords 19 and 20. More particularly, the loops established by the first and second tension cords 19 and 20 can be incrementally shortened and thus tightened by rotation of the first and second reels 17 and 18 in a first rotational direction, such as clockwise, and the loops established by the first and second tension cords 19 and 20 can be incrementally extended and thus loosened by rotation of the first and second reels 17 and 18 in a second rotational direction, such as counter-clockwise. In certain embodiments as illustrated, the reels 17 and 18 have a rotary knob. A sufficient pressing of the knob of the reel 17 or 18 is operative to engage the reels 17 and 18 for incremental tightening by reeling the respective tension cord 19 or 20 into the reel 17 or 18 and thus shortening the loop formed by the tension cord 19 or 20 and constricting the shoe 10 about the foot of the wearer. Conversely, a sufficient outward pulling of the knob of the reel 17 or 18 is operative to disengage the reel 17 or 18 to release the tension cords 19 and 20 for unreeling from the reel 17 or 18 thus extending the loop formed by the tension cord 19 or 20 and loosening the shoe 10 relative to the foot of the wearer.

Under this configuration, the first cord 19 and the first strap 26 with which it is engaged can be selectively and incrementally constricted about the shoe upper 12 adjacent to the foot opening of the shoe 10 and thus about the foot of a wearer received therein by a selective, clockwise rotation of the first reel 17 with the knob thereof pressed inwardly. In a similar manner, the second cord 20 and the second and third straps 28 and 30 with which it is engaged can be selectively and incrementally constricted about the mid-portion of the shoe 10 and thus about the foot of a wearer by a selective, clockwise rotation of the second reel 18 with the knob thereof pressed inwardly. Where incremental loosening of the straps 26, 28, and 30 is desired, the first or second reels 17 and 18 can be selectively and individually counter-rotated as desired by a sufficient pulling of the knob of the respective reel 17 or 18 outwardly to permit a release of the respective cord 18 or 20.

The first and second reels 17 and 18 can thus be selectively rotated and counter-rotated and the cords 18 and 20 selectively tightened and loosened in fine increments to produce an optimal, customized, and multi-directional fit over the length of the shoe 10. Precise and efficient incremental adjustments can be readily made thereto through incremental rotation or counter-rotation of either or both reels 17 or 18. Where a full and immediate loosening of the shoe 10 is desired, the reels 17 and 18 and the cords 18 and 20 retained thereby can be released by a sufficient outward pulling on the knobs of the reels 17 and 18.

Figure 19:
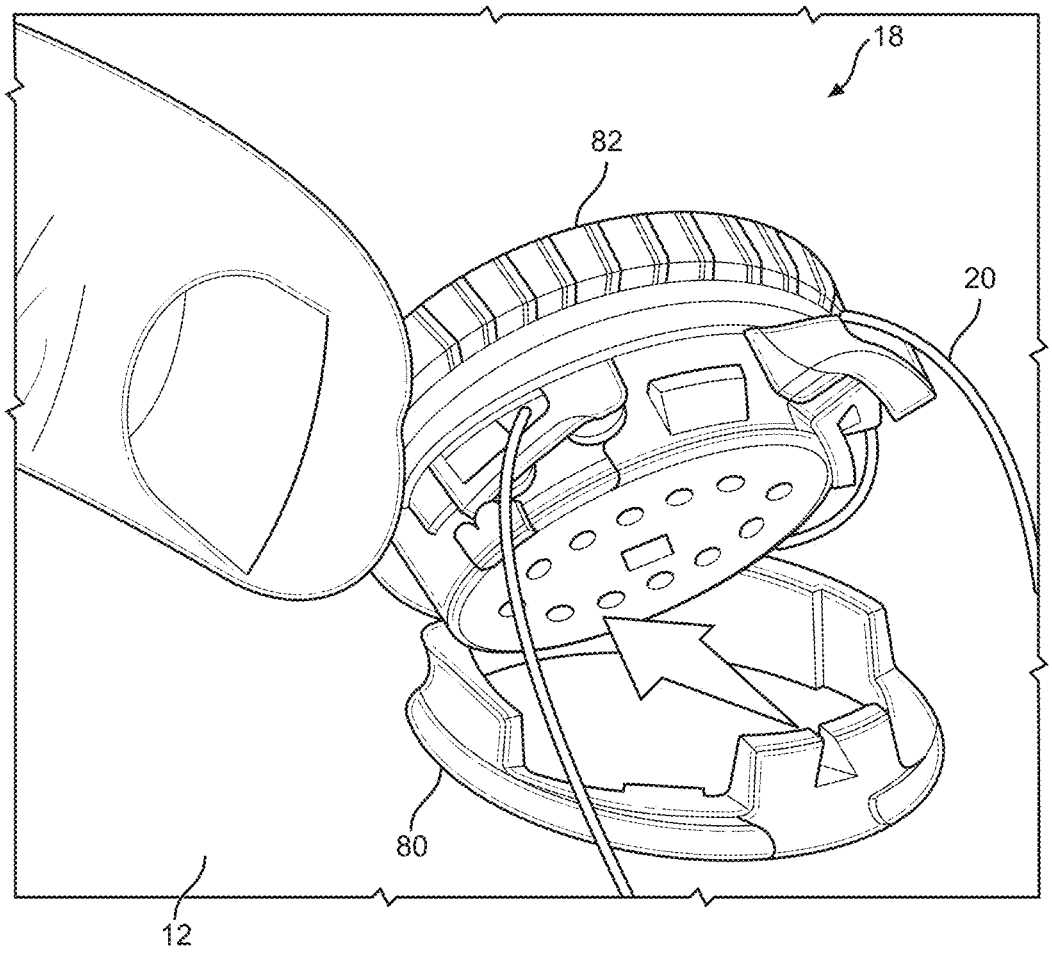
FIG. 19 is a partially-exploded perspective view of a reel-based lacing system according to the prior art as employed in embodiments of the trail running shoe.

With further reference to FIG. 19, where the second reel 18 is shown as an example, each reel 17 and 18 can be as disclosed in one or more of the patent disclosures referenced above. The reels 17 and 18 have base portions 80 fixed in place relative to the shoe upper 12, such as by sewing, adhesive, or any other method. A knob and spool combination 82 is received into and retained by the base portion 80. The cords 19 and 20 are incrementally rotated onto the spool of the knob and spool combination 82 to retract the cords 19 and 20 when the knob of the knob and spool combination 82 is rotated in the first rotational direction relative to the base portion 80, and the cords 19 and 20 are incrementally released from the spool to extend the cords 19 and 20 when the spool is rotated in a second rotational direction relative to the base portion 80. Absent such rotation of the knob and spool combinations 82, the cords 19 and 20 and the reels 17 and 18 are retained against inadvertent extension and retraction.

Figure 18:
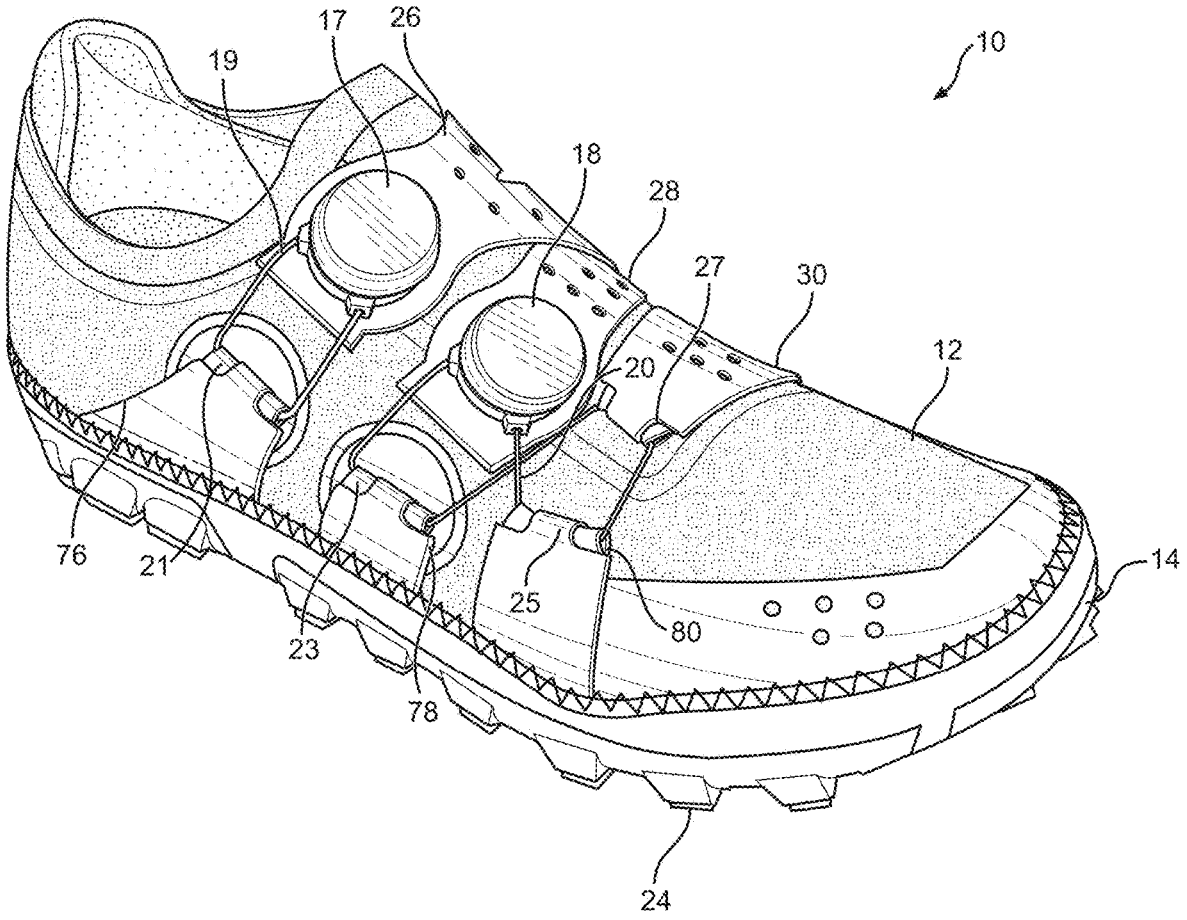
FIG. 18 is a perspective view an alternative embodiment of the trail running shoe.

With added reference to FIG. 18, it will be understood that the reels 17 and 18 could readily be oppositely disposed with respect to the straps 26, 28, and 30. Thus, in the embodiment depicted in FIG. 18, the first and second reels 17 and 18 are retained by the distal portions of the straps 26, 28, and 30 rather than being fixed to the shoe upper 12. First and second tension cords 19 and 20 are passed through low friction sleeves 21, 23, and 25 retained by first, second, and third anchor straps 76, 78, and 80 that are fixed adjacent to the junction between the shoe upper 12 and the outsole 14 to the outer side of the shoe 10. More particularly, the first tension cord 19, which forms a loop through the low friction sleeve 21 of the first anchor strap 76, is extendably and retractably retained by the first reel 17, and the second tension cord 20, which forms a loop through the low friction sleeve 23 of the second anchor strap 78, through the low friction sleeve 27 of the third strap 30, and through the low friction sleeve 25 of the third anchor strap 80, is extendably and retractably retained by the second reel 18. The reel-based tensioning system so established again permits the selective adjustment of the effective lengths of the loops formed by the first and second tension cords 19 and 20 by rotation and counter-rotation of the first and second reels 17 and 18 and, by so doing, an incremental adjustment of the precise fit of the trail running shoe 10.

In view of the potentially hostile nature of the environment in which the trail running shoes 10 are put to use, it is recognized that the first and second reels 17 and 18 may experience potentially damaging impacts, such as due to rocks, sticks, and other objects impacting on the trail running shoes 10. To minimize the risk of damage to the reels 17 and 18 and the fabric of the shoe upper 12, the knob and spool combinations 82 are designed to break away from the base portions 80 in response to sufficient force or impact thereon. The knob and spool combinations 82 can be readily re-engaged in a snap-fit relationship with the base portions 80 by an appropriate alignment thereof and with the application of sufficient depressive force on the knob and spool combinations 82.

The materials of the trail running shoe 10 and the methods of engagement of the components thereof are designed not only for strength, durability, and abrasion resistance during trail running but also for environmental sustainability. For instance, the shoe upper 12 in preferred embodiments is formed from a highly-durable, ultra-high-molecular-weight polyethylene fiber fabric, such as that manufactured and sold under the registered trademark DYNEEMA by the Naamloze Vennootschap DSM Corporation of the Netherlands. Also for strength, durability, and abrasion resistance, the shoe upper 12 is stitched to the rubber outsole 14 over the entire peripheries of the upper 12 and the outsole 14 by ultra-high-molecular-weight polyethylene fiber thread stitching 15, again such as is sold under the registered trademark DYNEEMA. As is illustrated, the stitching 15 may advantageously be disposed in a whip stitch, which may alternatively be referred to as a moccasin stitch.

By establishing the joining of the shoe upper 12 and the rubber outsole 14, which is one of the fundamental couplings of the trail running shoe 10, by stitching 15, a durable and secure coupling is established while the need for the use of glue for that coupling is minimized or eliminated. The joining by stitching 15 further promotes sustainability by permitting the relatively rapid disassembly of the shoe 10 at the end of its useful life. This ability to be rapidly disassembled facilitates, for example, individualized recycling of the components of the shoe 10. For instance, the rubber outsole 14 can be readily separated for advancement to a given recycling facility while the fabric of the shoe upper 12 can be readily forwarded to a different recycling facility. Moreover, due to the readily separable coupling and retention of plural components of the shoe 10 as will be shown and described further herein, components can be individually removed and replaced to extend the usable lifespan of the trail running shoe 10.

The structure and material of the outsole 14 markedly contributes to the durable and customizable nature of the trail running shoe 10. In preferred embodiments, for example, the outsole 14 is formed from a tough and durable rubber, such as rubber provided under the registered trademark MICHELIN by the Compagnie Generale Des Etablissements Michelin Societe en Commandite Par Actions (SCA) of France.

As referenced above, the outsole 14 has arrays of cuttable traction blocks 24 that project therefrom in a traction pattern. Each cuttable block 24 has a proximal base portion and a rectangular distal block portion that is narrowed in relation to the base portion. All or any part of the distal block portion can be selectively cut away, such as by opposed-jaw cutting pliers, by scissors, or by any other effective cutting tool. The distal block portions of the cuttable blocks 24 can be formed with an initial length adapted for selective trimming by the user. In one embodiment, for example, the distal block portions of the cuttable blocks 24 have an untrimmed length of approximately 3 millimeters.

So constructed, the cuttable blocks 24 can be readily trimmed and customized for selected fit, traction, and performance characteristics. For instance, a wearer might shape the contour of the arrays of cuttable blocks 24 to suit his or her individualized gait. Furthermore, a wearer may adapt the aggressiveness of the arrays of cuttable blocks 24 to expected trail conditions, such as by leaving the cuttable blocks 24 in a long condition to handle wet and potentially slippery conditions or by trimming them to a selectively shorter length where stable and dry trail conditions are expected while concomitantly rendering the trail running shoe 10 lighter.

Further adaptability of the trail running shoe 10 is provided by first and second cuttable drainage plugs 32. In the present embodiment, the drainage plugs 32 project centrally from a mid-portion of the outsole 14, such as from under the arch portion of the outsole 14. As is seen in FIG. 4, the drainage plugs 32 prior to any cutting have body portions that project from the outsole 14 with closed distal ends as is seen relative to the anterior drainage plug 32. As seen in relation to the posterior drainage plug 32 where the distal end of the plug 32 has been cut away, the closed distal ends seal off a conduit 33 that is open to the interior of the outsole 14 and the shoe 10 in general. As such, a user expecting to encounter conditions in which significant water may enter the shoe 10 can cut away either or both drainage plugs 32 by any effective tool including scissors, a knife, cutting pliers, or any other effective cutting tool. When a drainage plug 32 is sufficiently cut, an aperture is provided through the outsole 14 by the conduit 33 within the drainage plug 32 thereby to permit water to drain from the inner volume of the trail running shoe 10.

Figure 5:
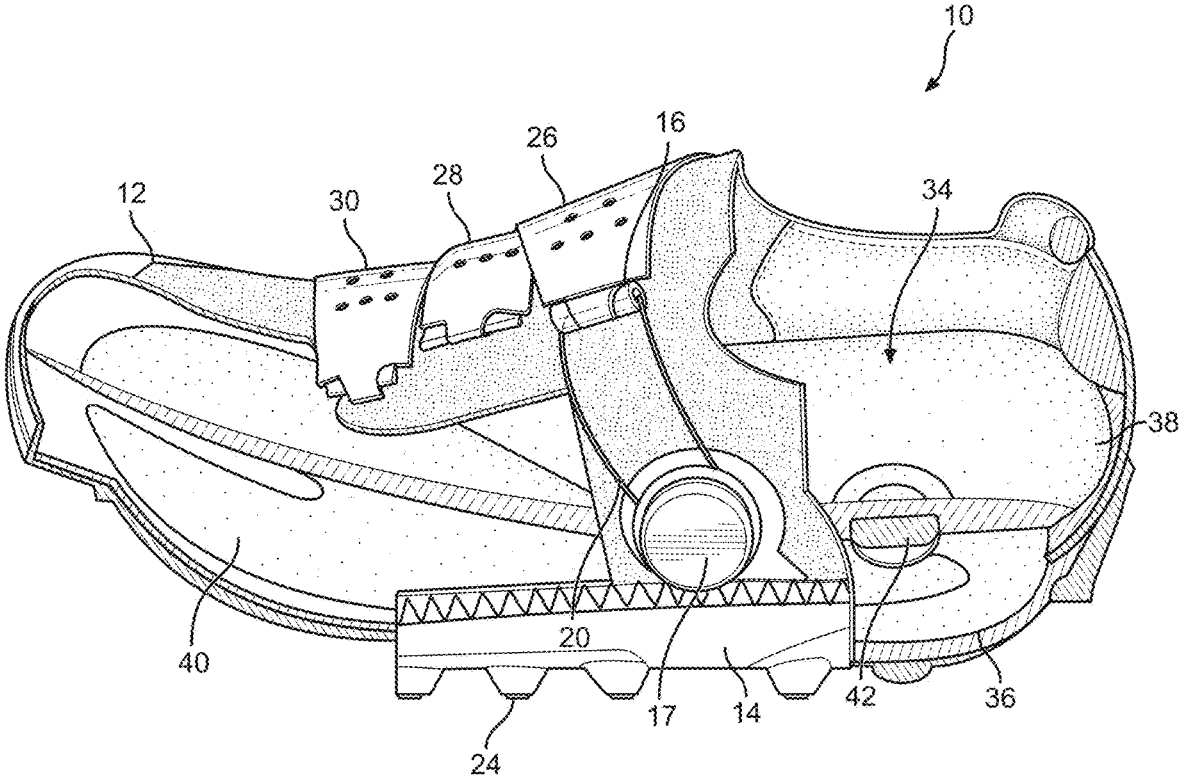
FIG. 5 is a sectioned perspective view of the trail running shoe of FIG. 1.

With particular reference to FIG. 5, a better understanding of the inner workings of the trail running shoe 10 can be had. There, one can perceive that, when the shoe 10 is fully assembled, a lower midsole 36 of a midsole assembly rests atop the rubber outsole 14. Edge portions of the shoe upper 12 are folded over to traverse at least partially over the lower midsole 36. An upper midsole 38 is disposed atop the lower midsole 36. A flexion plate 40 is secured in place between the upper midsole 38 and the lower midsole 36 of the midsole assembly and any overlapping portion of the shoe upper 12. Under this structure as basically described, the lower midsole 36, the upper midsole 38, and the flexion plate 40 cooperate to provide desirable ground feel, stability, protection, comfort, and energy return to the wearer of the trail running shoe 10.

The lower midsole 36 and the upper midsole 38 can be formed from resiliently compressible, flexible materials. According to practices of the invention, the midsoles 36 and 38 can be formed of the same or different materials. In one preferred embodiment, the lower midsole 36 is formed from a lightweight foam, such as ethylene-vinyl acetate (EVA), chosen to exhibit cushioning and good ground feel while providing protection to the feet of the wearer. The upper midsole 38 can be formed from a foam demonstrating higher energy return, low density, flexibility, and effective damping properties. By way of preferred example but not limitation, the upper midsole 38 can be formed from a polyether block amide (PEBA) foam or another thermoplastic elastomer (TPE) foam. One such foam is sold under the trademark PEBAX by the Arkema Corporation of France. PEBA foam has been found to demonstrate superior mechanical and dynamic properties, including flexibility, impact resistance, energy return, and fatigue resistance.

The flexion plate 40 is resiliently flexible but has greater rigidity than the flexible and resiliently compressible upper and lower midsoles 38 and 36. In certain embodiments, the flexion plate 40 comprises a plate of carbon fiber material. One such carbon fiber plate material is sold under the trademark CARBITEX by Carbitex, Inc. of Kennewick, Wash. According to embodiments of the invention, manifestations of the flexion plate 40 demonstrate asymmetric flexion characteristics. For instance, the material of the flexion plate 40 can demonstrate a given resistance to plantar flexion, which may be characterized as flexion of the plate 40 toward having a concave lower surface, but a greater resistance to dorsiflexion, which may be characterized as flexion of the plate 40 toward having a convex lower surface. When disposed within the shoe 10 as disclosed herein, the asymmetric flexion characteristics of the flexion plate 40 permit excellent ground feel due to permitted plantar flexion due to the given resistance of the flexion plate 40 and thus the shoe 10 to plantar flexion while demonstrating impact and sharps protection, stability, and enhanced energy return for propulsion due to the greater resistance of the flexion plate 40 and thus the shoe 10 to dorsiflexion.

The flexion plate 40 is retained in place within the trail running shoe 10 in a stable manner against longitudinal and lateral displacement without adhesive or permanent fastening. With that, the flexion plate 40 can be non-destructively removed and replaced relative to the shoe 10 by the end user without tools of any kind. Moreover, since the flexion plate 40 is not adhered, laminated, or otherwise permanently fixed to the adjacent upper and lower midsoles 38 and 36, it can, apart from the physical contact therebetween, flex independently of the adjacent layers.

As can be understood with reference to FIGS. 5 through 13, the flexion plate 40 in the depicted embodiment is removably retained in a depression 44 within the lower surface of the upper midsole 38 to form a flexion plate insert assembly 34. As shown, the depression 44 in the upper midsole 38 is bounded and defined by a raised peripheral portion of the body 45 of the midsole 38. The depression 44 substantially matches the body portion 48 of the flexion plate 40 in peripheral shape and thickness whereby, when the flexion plate 40 is aligned with and received into the depression 44, a substantially flat and continuous surface is presented as shown, for example, in FIG. 10. In the depicted embodiment, the flexion plate 40 and the depression 44 have a shape corresponding to the shape of a typical footprint. As such, each of the flexion plate 40 and the depression 44 has a forefoot portion, a heel portion, and a mid-foot arch portion therebetween.

The upper midsole 38 has a surface formation 46, such as a retaining protuberance 46 that projects inwardly from the periphery of the depression 44, and the flexion plate 40 has a correspondingly shaped and located receiving formation 50, such as a receiving aperture 50. In the present embodiment, the retaining protuberance 46 comprises an elongate ridge 46, and the receiving formation 50 comprises a corresponding elongate slot 50. The elongate ridge 46 and the elongate slot 50 are disposed in general alignment with a longitudinal of the forefoot portion of the trail running shoe 10. With that, lateral movement of the flexion plate 40 relative to the midsole 38 and the shoe 10 in general is prevented while mechanical interference between the midsole 38 and the flexion plate 40 during plantar flexion and dorsiflexion is avoided.

When selectively applied to the midsole 38, the flexion plate 40 is further locked in place by a mounting plug 42. In the depicted embodiment, the mounting plug 42 is fixedly retained by the upper midsole 38, such as by being formed integrally therewith or by being fixed thereto. As seen in FIGS. 9 through 13, the mounting plug 42 has a distal retaining lip 54 and a base portion 56. The base portion 56 is narrower than the retaining lip 54 such that the retaining lip 54 projects laterally outward of the base portion 56. The retaining lip 54 has a generally round portion that is substantially concentric with the base portion 56 and that is broader and extends laterally outward of the base portion by a given dimension and an eccentric lobe portion that projects laterally outward of the base portion by a dimension greater than that by which the generally round portion extends.

The flexion plate 40 has an aperture 52 therethrough disposed to align with and to receive the mounting plug 42. The aperture 52 has a round portion dimensioned to receive and retain the base portion 56 of the mounting plug 42 and an eccentric portion. The round portion of the aperture 52 has a width dimension smaller than the width dimension of the retaining lip 54 including the eccentric lobe portion thereof but sufficient to receive the base portion 56 of the mounting plug 42 whether in an interference fit or with some predetermined clearance therebetween.

Figure 6:
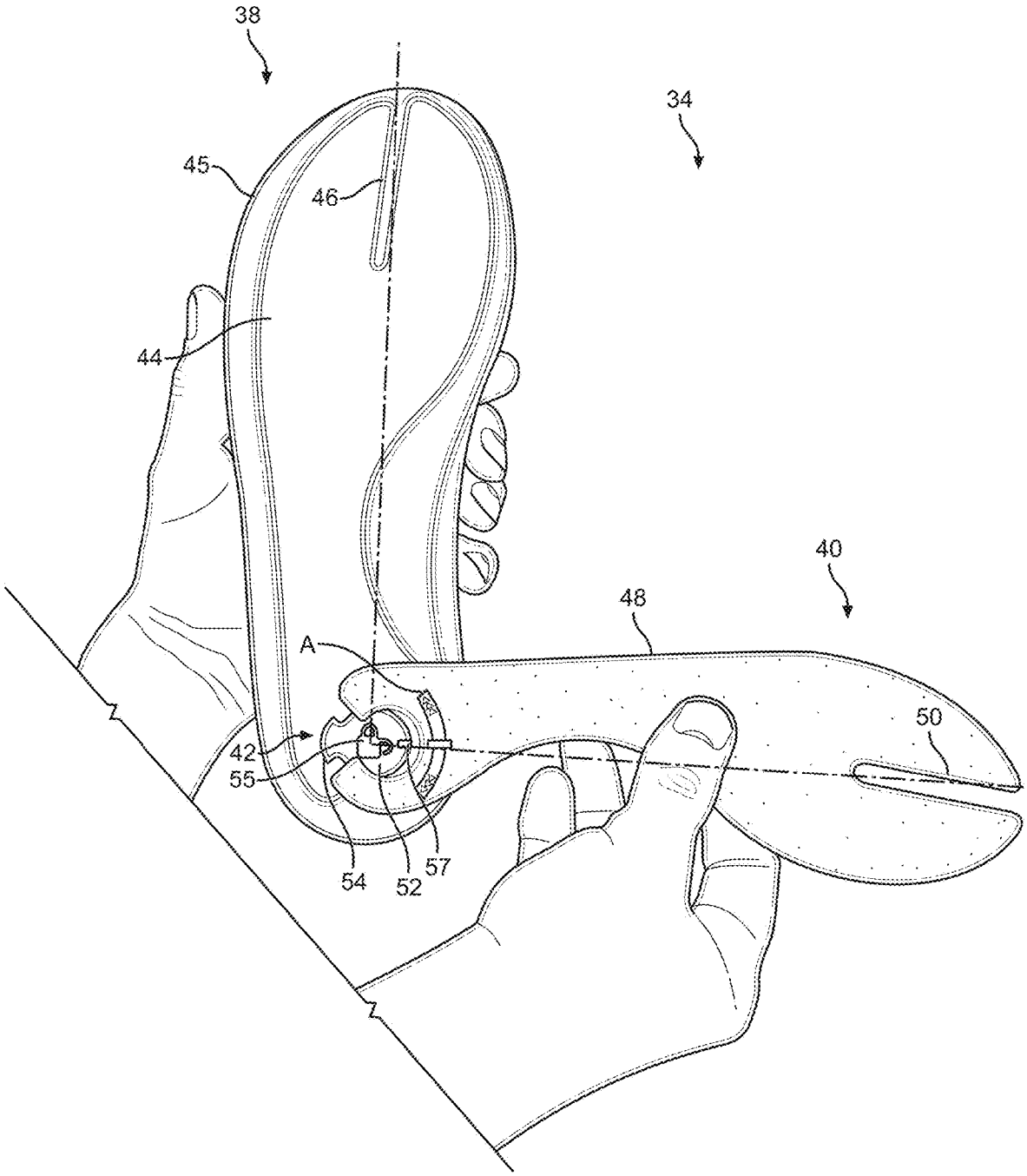
FIG. 6 is a bottom plan view of a flexion plate and shoe midsole during a stage of engagement between the flexion plate and the shoe midsole according to the present invention with the reinforcement plate aligned for application to the shoe midsole.
Figure 7:
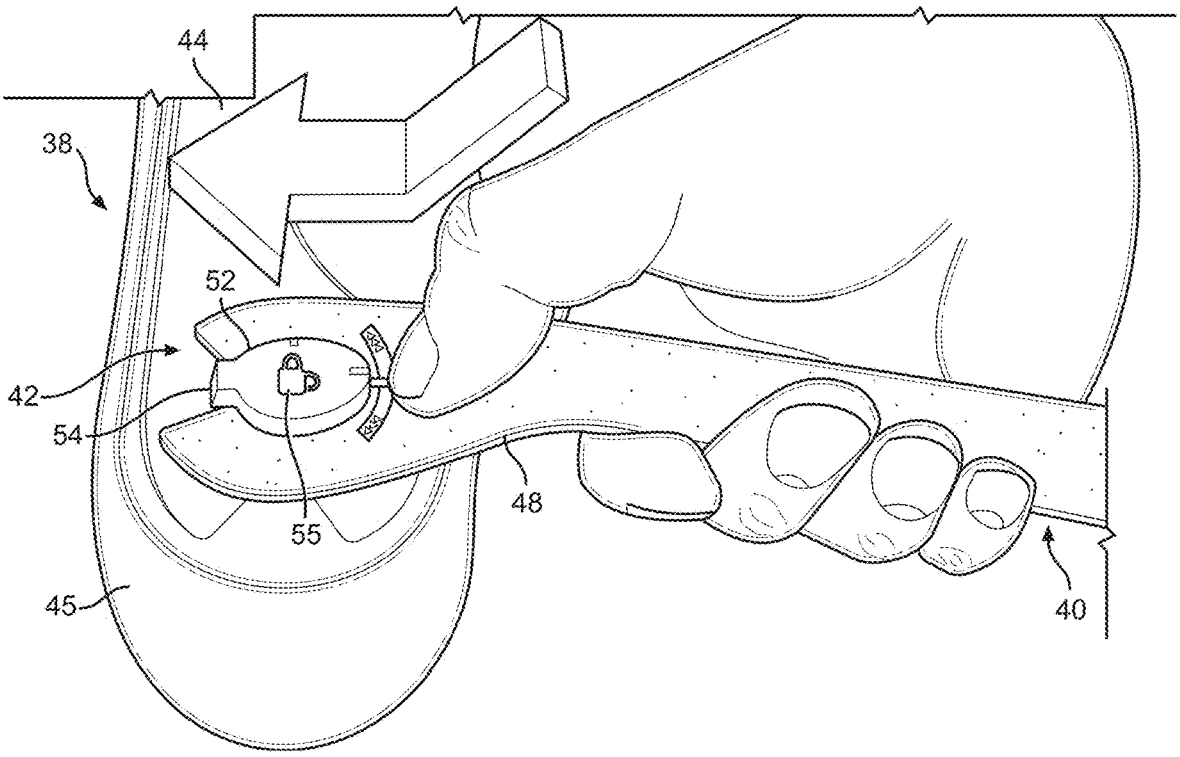
FIG. 7 is a perspective view of the flexion plate and the shoe midsole during a further stage of engagement between the flexion plate and the shoe midsole wherein the mounting plug of the shoe midsole is received into the mounting aperture of the flexion plate.
Figure 8:
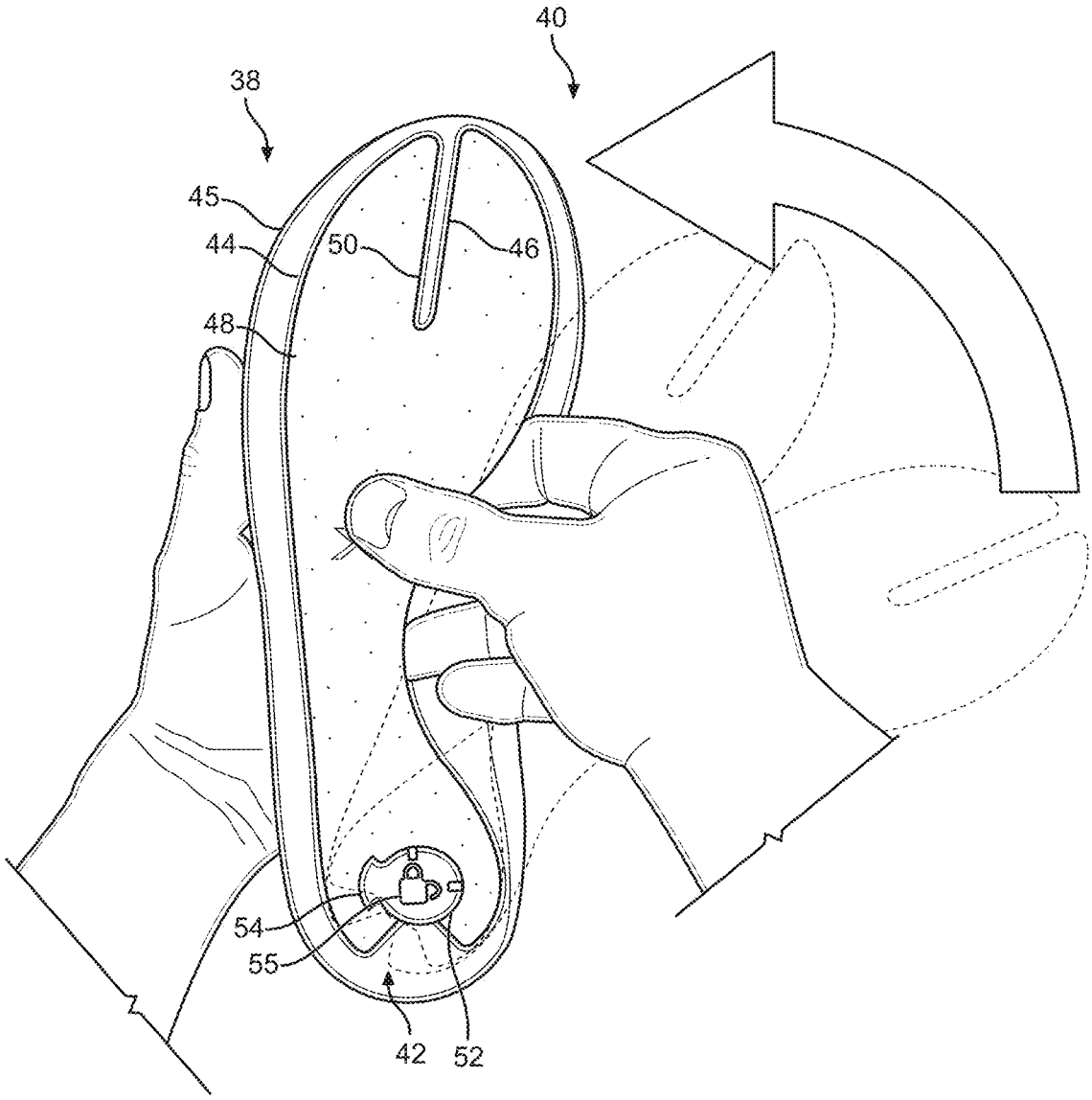
FIG. 8 is a bottom plan view of the flexion plate and the shoe midsole during a stage of engagement between the flexion plate and the shoe midsole wherein the flexion plate is rotated into alignment with the shoe midsole.
Figure 9:
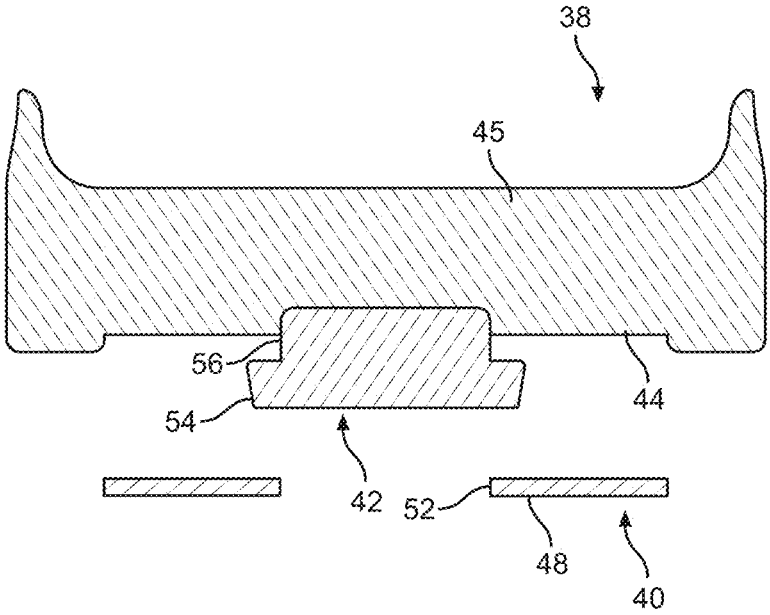
FIG. 9 is a lateral cross-sectional view of a flexion plate disposed for engagement with a shoe midsole as disclosed herein.
Figure 10:
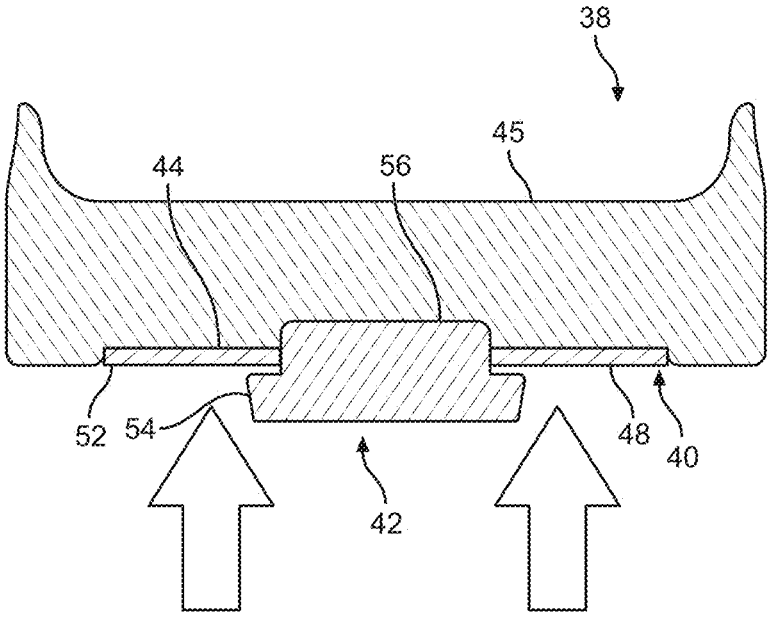
FIG. 10 is a lateral cross-sectional view of the flexion plate engaged with the shoe midsole.

In this non-limiting embodiment, the eccentric portion of the mounting plug 42 projects laterally toward the outer side of the midsole 38 while the eccentric portion of the aperture 52 in the flexion plate 40 is disposed to project longitudinally toward the posterior end of the flexion plate 40. The eccentric portions of the aperture 52 and retaining lip 54 are rotated out of alignment with one another when the longitudinal axes of the flexion plate 40 and the midsole 38 are in longitudinal alignment as, for instance, in FIG. 8. Where the eccentric lobe portion of the retaining lip 54 projects laterally with respect to the midsole 38 and the eccentric portion of the aperture 52 projects longitudinally with respect to the flexion plate 40 as in the current embodiment, the eccentric portions of the aperture 52 and the retaining lip 54 can be brought into alignment by a relative pivoting of the flexion plate 40 and the midsole 38 to cause their longitudinal axes to be disposed at a given, non-zero angle, in this example approximately ninety degrees, to the approximately perpendicular relationship as is illustrated in FIG. 6.

In the present embodiment, the aperture 52 in the flexion plate 40 is open to the posterior end of the flexion plate 40 such that the aperture 52 comprises an inlet into the plate 40, but such need not necessarily be the case. Where the aperture 52 is open to the posterior end of the flexion plate 40, the posterior end of the plate 40 can be considered to be divided into a split tail portion.

Under the foregoing configuration, the flexion plate 40 can be readily removed and replaced relative to the upper midsole 38 and in relation to the trail running shoe 10 in general. The trail running shoe 10 can thus be further adapted to specific running conditions and preferences, including by removal or insertion of the flexion plate 40, by the insertion of flexion plates 40 having different characteristics, or even by the selective tailoring, such as by cutting or other physical adjustment, of the flexion plate 40 to achieve desired flexion properties.

One method for engaging the flexion plate 40 with the upper midsole 38 and installing the joined midsole 38 and flexion plate 40 within a trail running shoe 10 can be understood with reference to the progressive views of FIGS. 6 through 12. There, a flexion plate 40 is first held at approximately a laterally perpendicular orientation relative to the midsole 38 with the eccentric portions of the aperture 52 in the flexion plate 40 and the retaining lip 54 of the mounting plug 42 aligned and with the aperture 52 in the flexion plate 40 slightly laterally displaced from the retaining lip 54 toward the inner side of the midsole 38. To facilitate this orientation, the mounting plug 42 and the flexion plate 40 have alignment markings 55 and 57 disposed thereon. Then, the flexion plate 40 can be pressed over the retaining lip 54 or otherwise manipulated to cause the base portion 56 of the mounting plug 42 to be snugly received into the round portion of the aperture 52 in the flexion plate 40. This can be done, for example, by pushing the flexion plate 40 toward the midsole 38 and laterally toward the eccentric portion of the retaining lip 54 thereby to cause the split tail portion of the flexion plate 40 to snap into place around the base portion 56 of the mounting plug 42. With the mounting plug 42 so received, the flexion plate 40 can be pivoted about the mounting plug 42 into position aligned with the depression 44 in the midsole 38. The flexion plate 40 can then be matingly received into the depression 44.

Figure 11:
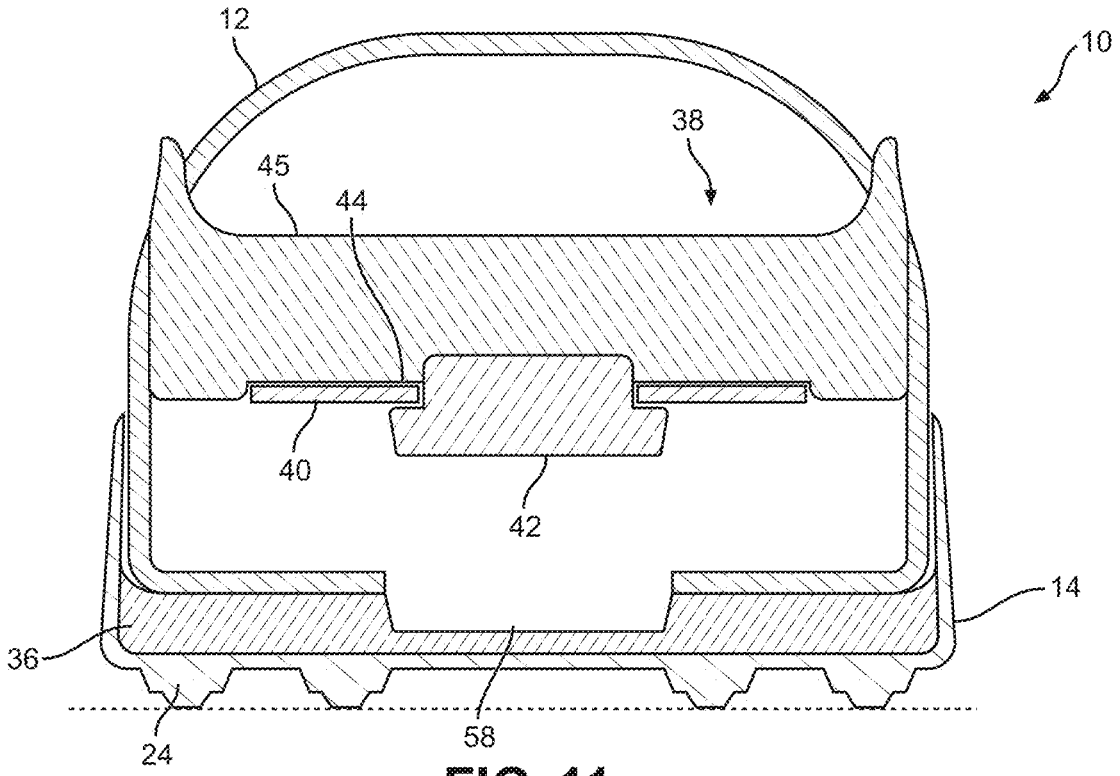
FIG. 11 is a lateral cross-sectional view of an engaged flexion plate and shoe midsole combination received within a shoe cavity formed by a shoe upper and a shoe outsole.
Figure 12:
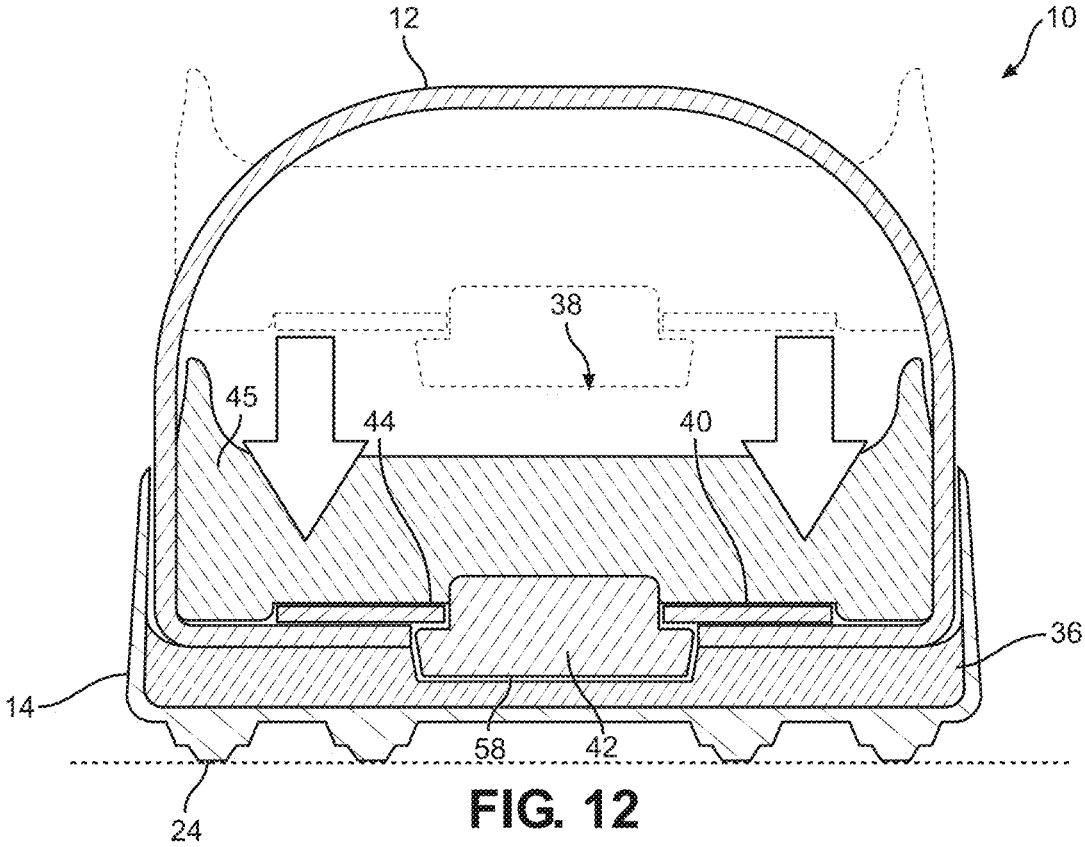
FIG. 12 is a lateral cross-sectional view of the engaged flexion plate and shoe midsole combination in stages of engagement with a lower midsole within the shoe cavity formed by the shoe upper and the shoe outsole.
Figure 13:
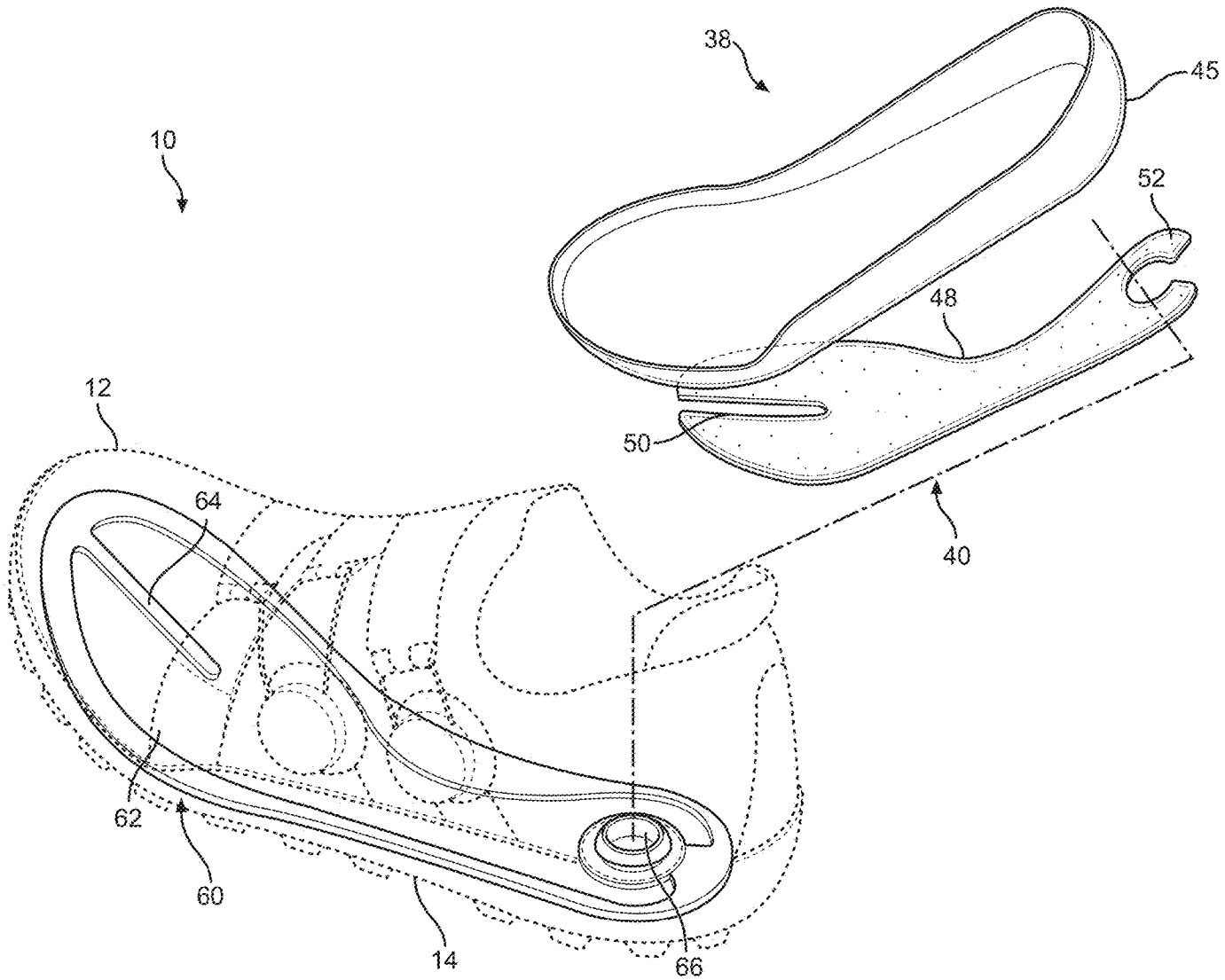
FIG. 13 is a perspective view of an alternative configuration for retaining a mounting plate within a trail running shoe as taught herein.
Figure 14:
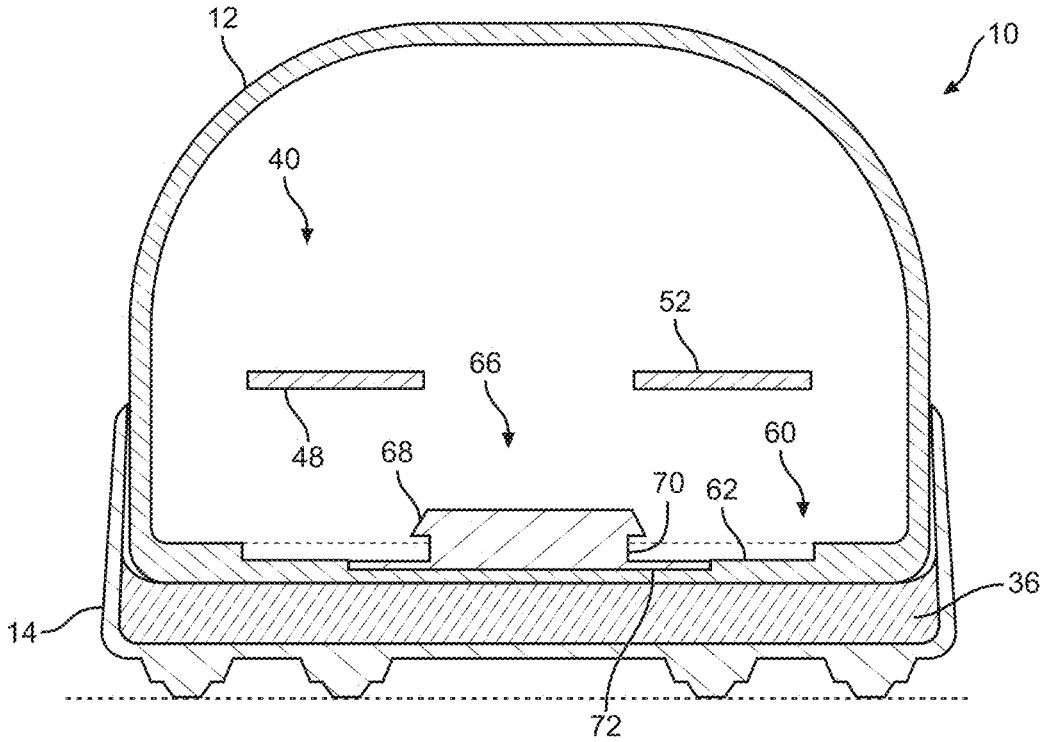
FIG. 14 is a lateral cross-sectional view of the configuration for retaining a mounting plate within a trail running shoe of FIG. 13 with the flexion plate detached from a plate mounting plug retained by a shoe strobel.
Figure 15:
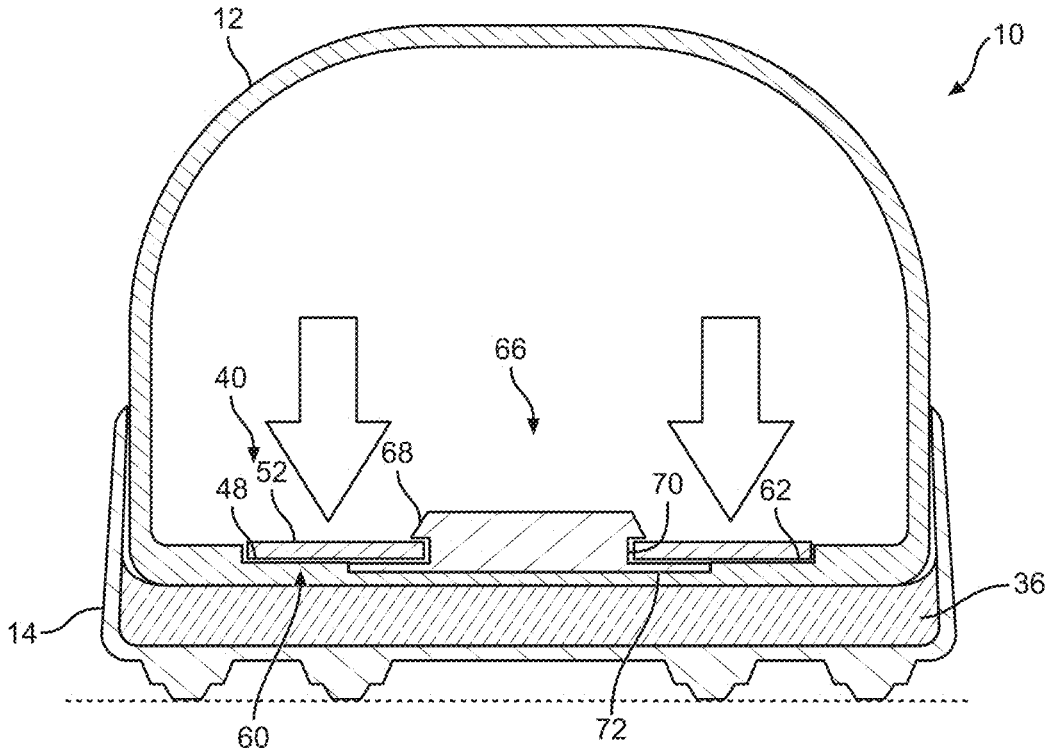
FIG. 15 is a lateral cross-sectional view of the configuration for retaining a flexion plate within a trail running shoe of FIG. 13 with the flexion plate attached to the plate mounting plug.
Figure 16:
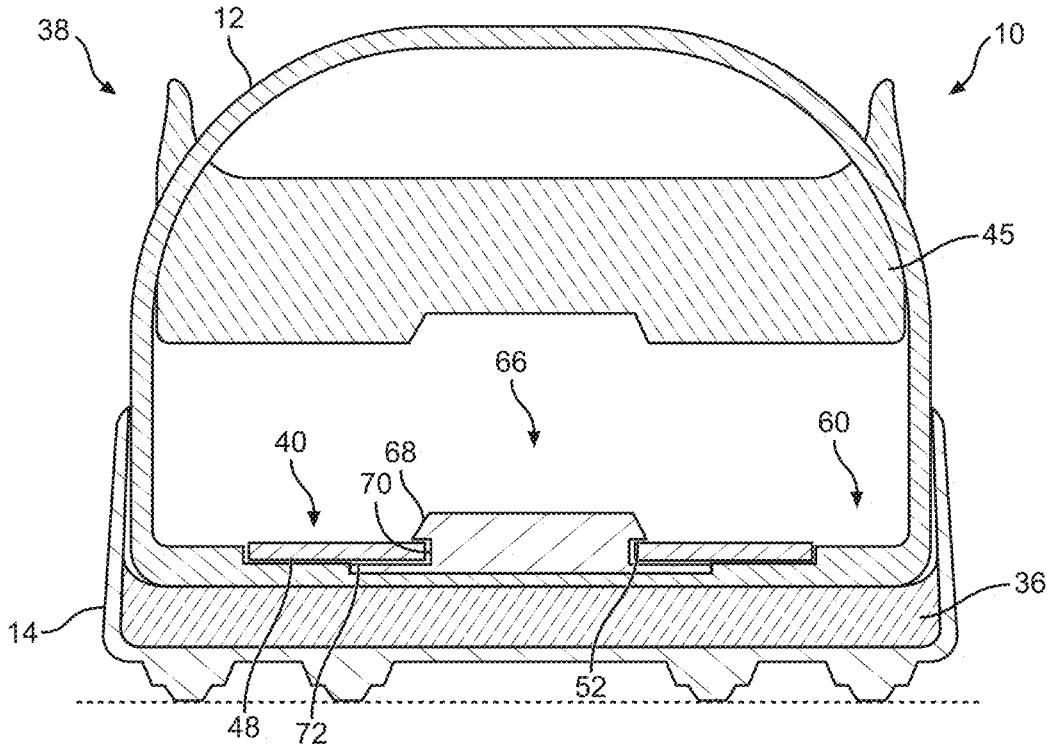
FIG. 16 is a lateral cross-sectional view of the configuration for retaining a flexion plate within a trail running shoe of FIG. 13 with the flexion plate attached to the plate mounting plug and with a shoe midsole disposed to be received atop the shoe strobel and the flexion plate attached to the shoe strobel.
Figure 17:
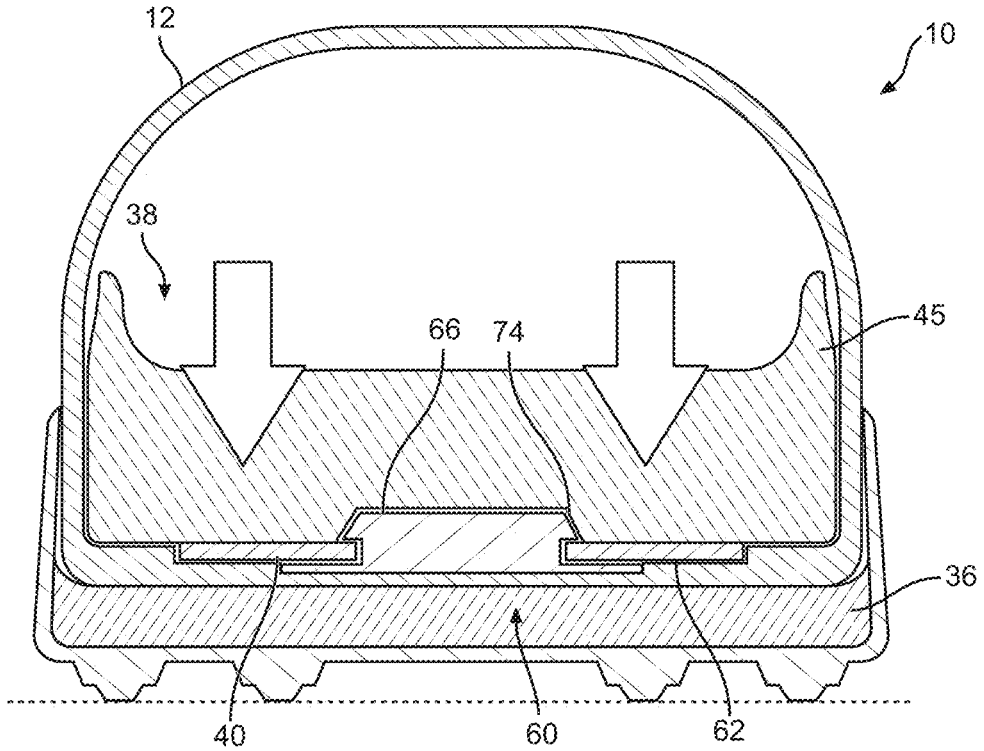
FIG. 17 is a lateral cross-sectional view of the configuration for retaining a flexion plate within a running shoe of FIG. 13 with the shoe midsole disposed atop the shoe strobel and the flexion plate attached to the shoe strobel.

With the upper midsole 38 and the flexion plate 40 so engaged, the joined components can be inserted into the inner volume of the trail running shoe 10 as shown in FIG. 11 and pushed into place and into supporting contact with the lower components of the shoe 10, which in this embodiment comprise the lower midsole 36 and the overturned portion of the shoe upper 12. Where necessary to receive the distal portion of the mounting plug 42, the lower midsole 36 can have an aligned depression 58 therein as shown in FIGS. 11 and 12.

Again, since it is not retained by adhesive or permanent fasteners, the flexion plate 40 can be readily removed, such as for trimming, performance adaptation, or otherwise. To do so, the installation steps can essentially be performed in reverse, such as by first removing the coupled midsole 38 and flexion plate 40 from within the inner volume of the shoe 10. Then, the flexion plate 40 can be gripped and rotated to approximately a laterally perpendicular orientation relative to the midsole 38 thereby causing the eccentric portions of the aperture 52 in the flexion plate 40 and the retaining lip 54 of the mounting plug 42 to be brought into alignment. Then, the mounting plug 42 can be disengaged from the aperture 52 in the flexion plate 40, such as by pressing the mounting plug 42 through the aperture 52, to separate the flexion plate 40 and the midsole 38 thereby permitting the desired replacement, removal, or performance adjustment of the flexion plate 40.

It will again be appreciated that the foregoing is merely one embodiment of the broader invention disclosed herein. Other embodiments shall be considered to be included within the scope of the claims. Certain aspects of one such alternative embodiment are depicted in FIGS. 13 through 17. There, a lower midsole 36, an upper midsole 38, and a flexion plate 40 are again included for being received into a body of the shoe 10 formed by a shoe upper 12 joined with a shoe outsole 14. Here, however, the flexion plate 40 is retained within a depression 62 in a molded strobel 60 that is disposed atop the lower midsole 36. The depression 62 again substantially matches the flexion plate 40 in peripheral shape and depth. The strobel 60 has a surface formation 64, such as a retaining protuberance 64, that projects inwardly from the periphery of the depression 62, and the flexion plate 40 again has a correspondingly shaped receiving formation 50, such as a receiving slot aperture 50. A mounting plug 66 with a distal lip portion 68 and a base portion 70 is retained to project from the strobel 60 whether by being fixed thereto or integrally formed therewith. The upper midsole 38 has a depression 74 therein aligned with the mounting plug 66 for receiving the distal portion of the mounting plug 66.

Under this configuration, the flexion plate 40 can be selectively installed and removed in relation to the trail running shoe 10. For instance, as in FIG. 14, the aperture 52 in the flexion plate 40 can be aligned with the mounting plug 66. The body portion 48 and the receiving slot formation 50 of the flexion plate 40 can be matingly engaged with the depression 62 and the retaining protuberance 64 of the strobel 60. The aperture 52 in the flexion plate 40 can then be pressed over the distal lip portion 68 of the plug 66 to cause the base portion 70 of the plug 66 to be received and retained within the aperture 52 in the flexion plate 40. With the flexion plate 40 and the strobel 60 in place within the inner volume of the shoe 10 as shown, for example, in FIG. 15, the upper midsole 38 can be inserted and disposed in facing contact with the strobel 60 and the flexion plate 40 as in the progressive views of FIGS. 16 and 17.

The structures and methods for retaining a flexion plate 40 as disclosed hereinabove, while advantageous, are not intended to be limiting except as may expressly be set forth by the claims. For instance, except as may be expressly excluded by the claims, retention of the flexion plate 40 with a mounting plug 42 may be supplemented or supplanted by other mechanisms for retention. By way of further example and not limitation, the flexion plate 40 could additionally or alternatively be retained by magnetic coupling, by adhesive, by friction fit, by boundary retention, by mechanical fasteners, by snap-fit, by buttons, by hook and loop material, or by any other effective method for retention or a combination thereof.

It will be understood that terms of orientation, nomenclature, and other conventions used herein merely provide a complete understanding of the disclosed trail running shoe 10 and are not limiting. Other conventions may be used without limitation of the teachings herein. Furthermore, the various components disclosed herein are merely illustrative and are not limiting of the invention. For example, except as limited by the claims, each of the components and steps discussed herein may include subcomponents or substeps that collectively provide for the structure and function of the disclosed component or step. Still further, one or more components or steps, sometimes referred to as members or otherwise herein, could be combined as a unitary structure or a single step while still corresponding to the disclosed components or steps. Additional components and steps that provide additional functions, or enhancements to those introduced herein, may be included. For example, additional components, steps, and materials, combinations of components, steps, or materials, and perhaps the omission of components, steps, or materials may be used to create embodiments that are nonetheless within the scope of the teachings herein.

When introducing elements of the present invention or embodiments thereof, the articles "a," "an," and "the" are intended to mean that there are one or more of the elements. The terms "comprising," "including," and "having" are intended to be inclusive such that there may be additional elements other than the listed elements. As used herein, the terms "example" or "exemplary" are not intended to imply superlative examples. Rather, "exemplary" and "example" refer to an embodiment that is one of many possible embodiments.

With certain details and embodiments of the present invention for a trail running shoe and flexion plate insert for a running shoe disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. A plurality of the following claims may express, or be interpreted to express, certain elements as means for performing a specific function, at times without the recital of structure or material. As the law demands, any such claims shall be construed to cover not only the corresponding structure and material expressly described in this specification but also all legally-cognizable equivalents thereof.

We claim the following as deserving the protection of Letters Patent:

1. A running shoe comprising:

a shoe upper;

a shoe outsole, wherein the shoe upper and the shoe outsole are joined to define an inner volume of the running shoe for receiving a foot of a wearer;

a first midsole for being retained within the inner volume of the running shoe;

a mounting plug retained by the first midsole for being retained within the inner volume of the running shoe with the first midsole wherein the mounting plug has a base portion and a distal retaining lip;

a tensioning system operable to selectively constrict the shoe upper about the foot of the wearer;

traction formations disposed in an array to project from the shoe outsole;

a flexion plate, wherein the flexion plate is non-destructively removable and replaceable within the inner volume of the running shoe, wherein the flexion plate exhibits a resistance to plantar flexion and a resistance to dorsiflexion, and wherein the flexion plate has an aperture therein for selectively receiving the mounting plug retained by the first midsole whereby the flexion plate can be selectively coupled with the first midsole by engagement of the mounting plug retained by the first midsole with the aperture of the flexion plate and whereby the flexion plate and the first midsole so coupled can be disposed within the inner volume of the running shoe; and a second midsole for being retained within the inner volume of the running shoe, wherein the first and second midsoles are adapted to be disposed in a facing relationship with one another with the mounting plug retained by the first midsole facing the second midsole and with the flexion plate disposed between the first and second midsoles.

2. The running shoe of claim 1, wherein the flexion plate exhibits asymmetric flexion characteristics wherein the resistance of the flexion plate to plantar flexion is different than the resistance of the flexion plate to dorsiflexion.

3. The running shoe of claim 2, wherein the resistance of the flexion plate to dorsiflexion is greater than the resistance of the flexion plate to plantar flexion.

4. The running shoe of claim 2, wherein the flexion plate is formed from carbon fiber material with asymmetric flexion characteristics.

5. The running shoe of claim 1, wherein the first midsole has a depression therein for receiving the flexion plate and wherein the depression and the flexion plate have correspondingly shaped peripheries.

6. The running shoe of claim 5, wherein the first midsole has a protuberating surface formation that projects within the depression and wherein the flexion plate has a correspondingly shaped and located receiving formation.

7. The running shoe of claim 6, wherein the running shoe has a forefoot portion and wherein the receiving formation of the flexion plate comprises an elongate slot.

8. The running shoe of claim 7, wherein the flexion plate has a posterior end and wherein the aperture in the flexion plate is open to the posterior end of the flexion plate whereby the aperture comprises an inlet into the flexion plate and whereby the posterior end of the flexion plate is divided into a split tail portion.

9. The running shoe of claim 1, wherein the distal retaining lip has an eccentric lobe portion and wherein the aperture in the flexion plate has an eccentric portion for being selectively aligned with the eccentric lobe portion.

10. The running shoe of claim 9, wherein the first midsole and the flexion plate have longitudinal axes and wherein the eccentric lobe portion of the distal retaining lip and the eccentric portion of the aperture are out of alignment when the longitudinal axes of the flexion plate and the first midsole are in alignment and wherein the eccentric lobe portion of the distal retaining lip and the eccentric portion of the aperture can be brought into alignment by a disposition of the longitudinal axis of the flexion plate at a predetermined, non-zero angle relative to the longitudinal axis of the first midsole.

11. The running shoe of claim 10, wherein the eccentric lobe portion of the distal retaining lip and the eccentric portion of the aperture can be brought into alignment by a disposition of the longitudinal axis of the flexion plate at an angle of approximately ninety degrees relative to the longitudinal axis of the first midsole.

12. The running shoe of claim 1, wherein the second midsole comprises a lower midsole and wherein the first midsole comprises an upper midsole and wherein the first midsole and the flexion plate are adapted to be disposed atop the second midsole.

13. The running shoe of claim 1, wherein the traction formations disposed to project from the shoe outsole each have a proximal base portion and a distal block portion that is narrowed in relation to the proximal base portion and wherein the distal block portions are adapted to be selectively and individually trimmed thereby to permit selected, adaptable fit, traction, and performance characteristics.

14. The running shoe of claim 1, further comprising a cuttable drainage plug in the outsole wherein the drainage plug has a distal end that closes off a conduit that is open to fluidic communication with the inner volume of the running shoe and wherein the distal end of the drainage plug is adapted to be selectively cut away to permit water to drain from the inner volume of the trail running shoe.

15. A running shoe comprising:

a shoe upper;

a shoe outsole, wherein the shoe upper and the shoe outsole are joined to define an inner volume of the running shoe for receiving a foot of a wearer;

a first midsole for being retained within the inner volume of the running shoe;

a mounting plug retained by the first midsole for being retained within the inner volume of the running shoe with the first midsole wherein the mounting plug has a base portion and a distal retaining lip;

a tensioning system operable to selectively constrict the shoe upper about the foot of the wearer;

traction formations disposed in an array to project from the shoe outsole; and a flexion plate, wherein the flexion plate is non-destructively removable and replaceable within the inner volume of the running shoe, wherein the flexion plate exhibits a resistance to plantar flexion and a resistance to dorsiflexion, and wherein the flexion plate has an aperture therein for selectively receiving the mounting plug retained by the first midsole whereby the flexion plate can be selectively coupled with the first midsole by engagement of the mounting plug retained by the first midsole with the aperture of the flexion plate and whereby the flexion plate and the first midsole so coupled can be disposed within the inner volume of the running shoe;

wherein the distal retaining lip has an eccentric lobe portion and wherein the aperture in the flexion plate has an eccentric portion for being selectively aligned with the eccentric lobe portion;

wherein the first midsole and the flexion plate have longitudinal axes and wherein the eccentric lobe portion of the distal retaining lip and the eccentric portion of the aperture are out of alignment when the longitudinal axes of the flexion plate and the first midsole are in alignment and wherein the eccentric lobe portion of the distal retaining lip and the eccentric portion of the aperture can be brought into alignment by a disposition of the longitudinal axis of the flexion plate at a predetermined, non-zero angle relative to the longitudinal axis of the first midsole; and wherein the flexion plate has a posterior end and wherein the aperture in the flexion plate is open to the posterior end of the flexion plate whereby the aperture comprises an inlet into the flexion plate and whereby the posterior end of the flexion plate is divided into a split tail portion.

16. A running shoe comprising:

a shoe upper;

a shoe outsole, wherein the shoe upper and the shoe outsole are joined to define an inner volume of the running shoe for receiving a foot of a wearer;

a first midsole comprising an upper midsole for being retained within the inner volume of the running shoe;

a mounting plug for being retained within the inner volume of the running shoe, wherein the mounting plug is retained by the first midsole, wherein the mounting plug has a base portion and a distal retaining lip, wherein the distal retaining lip has an eccentric lobe portion;

a second midsole comprising a lower midsole for being retained within the inner volume of the running shoe;

a flexion plate wherein the flexion plate is non-destructively removable and replaceable within the inner volume of the running shoe, wherein the flexion plate exhibits a resistance to plantar flexion and a resistance to dorsiflexion, wherein the flexion plate has an aperture therein for selectively receiving the mounting plug, and wherein the aperture in the flexion plate has an eccentric portion for being selectively aligned with the eccentric lobe portion of the distal retaining lip of the mounting plug whereby the flexion plate can be selectively coupled with the first midsole by engagement of the mounting plug retained by the first midsole with the aperture of the flexion plate, wherein the first midsole and the flexion plate have longitudinal axes, wherein the eccentric lobe portion of the distal retaining lip and the eccentric portion of the aperture are out of alignment when the longitudinal axes of the flexion plate and the first midsole are in alignment, and wherein the eccentric lobe portion of the distal retaining lip and the eccentric portion of the aperture can be brought into alignment by a disposition of the longitudinal axis of the flexion plate at a predetermined, non-zero angle relative to the longitudinal axis of the first midsole;

wherein the first and second midsoles are adapted to be disposed in a facing relationship with one another with the first midsole atop the second midsole, with the mounting plug retained by the first midsole facing the second midsole, and with the flexion plate disposed between the first and second midsoles;

a tensioning system operable to selectively constrict the shoe upper about the foot of the wearer; and traction formations disposed in an array to project from the shoe outsole.

17. The running shoe of claim 16, wherein the flexion plate exhibits asymmetric flexion characteristics wherein the resistance of the flexion plate to dorsiflexion is greater than the resistance of the flexion plate to plantar flexion.

18. The running shoe of claim 16, wherein the first midsole has a depression therein for receiving the flexion plate and wherein the depression and the flexion plate have correspondingly shaped peripheries.

19. The running shoe of claim 18, wherein the first midsole has a protuberating surface formation that projects within the depression and wherein the flexion plate has a correspondingly shaped and located receiving formation.

20. The running shoe of claim 19, wherein the running shoe has a forefoot portion and wherein the receiving formation of the flexion plate comprises an elongate slot.

21. The running shoe of claim 20, wherein the flexion plate has a posterior end and wherein the aperture in the flexion plate is open to the posterior end of the flexion plate whereby the aperture comprises an inlet into the flexion plate and whereby the posterior end of the flexion plate is divided into a split tail portion.

22. The running shoe of claim 16, wherein the flexion plate has a posterior end and wherein the aperture in the flexion plate is open to the posterior end of the flexion plate whereby the aperture comprises an inlet into the flexion plate and whereby the posterior end of the flexion plate is divided into a split tail portion.

* * * * *